US006694034B2

(12) United States Patent
Julstrom et al.

(10) Patent No.: US 6,694,034 B2
(45) Date of Patent: Feb. 17, 2004

(54) TRANSMISSION DETECTION AND SWITCH SYSTEM FOR HEARING IMPROVEMENT APPLICATIONS

(75) Inventors: Stephen D. Julstrom, Chicago, IL (US); Elmer V. Carlson, Glenview, IL (US); Norman P. Matzen, Campbell, CA (US); Robert B. Schulein, Evanston, IL (US); Willem Soede, JL Leiden (NL)

(73) Assignee: Etymotic Research, Inc., Elk Grove Village, IL (US)

( * ) Notice: Subject to any disclaimer, the term of this patent is extended or adjusted under 35 U.S.C. 154(b) by 152 days.

(21) Appl. No.: 09/752,806

(22) Filed: Dec. 28, 2000

(65) Prior Publication Data

US 2003/0044033 A1 Mar. 6, 2003

Related U.S. Application Data

(60) Provisional application No. 60/174,958, filed on Jan. 7, 2000, and provisional application No. 60/225,840, filed on Aug. 16, 2000.

(51) Int. Cl.[7] ..... H04R 25/00

(52) U.S. Cl. ..... 381/315

(58) Field of Search ..... 381/312, 313, 381/315, 320, 321, 324, 23.1, 151, 314, 317, 318; 455/569.1, 41.2, 575.2, 556, 557; 379/55.1, 56.1, 56.3

(56) References Cited

U.S. PATENT DOCUMENTS 4,920,570 A 4/1990 West et al. ..... 381/68
5,824,022 A 10/1998 Zilberman et al. ..... 607/57
5,835,610 A * 11/1998 Ishige et al. ..... 381/315
6,101,258 A 8/2000 Killion et al. ..... 381/321
6,112,103 A 8/2000 Puthuff ..... 455/557
6,307,945 B1 * 10/2001 Hall ..... 381/315
6,438,245 B1 * 8/2002 Taenzer et al. ..... 381/330

* cited by examiner

*Primary Examiner*—Curtis Kuntz
*Assistant Examiner*—Brian Ensey
(74) *Attorney, Agent, or Firm*—McAndrews, Held & Malloy, Ltd.

(57) ABSTRACT

A hearing aid system for selecting one of two audio sources is disclosed. The hearing aid system comprises hearing aid circuitry, such as, for example, a hearing aid amplifier and speaker, as well as a primary source for audio, such as, for example, a hearing aid microphone. The hearing aid system also comprises a secondary source for audio, such as, for example, a directional microphone worn or otherwise supported by a person speaking or by the hearing aid user, as well as detection and switch circuitry to select which of the primary and secondary audio sources should be directed to the hearing aid circuitry. In operation, the detection and switch circuitry receives a signal transmission (preferably wireless) from the secondary audio source and determines whether the signal received is desirable. If the signal transmission is desirable, the circuitry selects that signal for coupling with the hearing aid circuitry. If the transmission signal is not desirable, the circuitry selects the signals from the primary audio source for coupling with the hearing aid circuitry.

40 Claims, 25 Drawing Sheets

TRANSMISSION DETECTION AND SWITCH SYSTEM FOR HEARING IMPROVEMENT APPLICATIONS

CROSS-REFERENCE TO RELATED APPLICATIONS

This application makes reference to, and claims priority to, U.S. provisional applications Ser. No. 60/174,958 filed Jan. 7, 2000 and Ser. No. 60/225,840 filed Aug. 16, 2000.

INCORPORATION BY REFERENCE

The above-referenced U.S. provisional applications Ser. No. 60/174,958 and Ser. No. 60/225,840 are hereby incorporated herein by reference in their entirety. U.S. Pat. No. 6,009,311 is hereby incorporated by reference in its entirety.

STATEMENT REGARDING FEDERALLY SPONSORED RESEARCH OR DEVELOPMENT

N/A

BACKGROUND OF THE INVENTION

Numerous types of hearing aids are known and have been developed to assist individuals with hearing loss. Examples of hearing aid types currently available include behind the ear (BTE), in the ear (ITE), in the canal (ITC) and completely in the canal (CIC) hearing aids. In many situations, however, hearing impaired individuals may require a hearing solution beyond that which can be provided by such a hearing aid alone. For example, hearing impaired individuals often have great difficulty carrying on normal conversations in noisy environments, such as parties, meetings, sporting events or the like, involving a high level of background noise. In addition, hearing impaired individuals also often have difficulty listening to audio sources located at a distance from the individual, or to several audio sources located at various distances from the individual and at various positions relative to the individual.

Many objects, aspects and variations of the present invention will become apparent to one of skill in the art upon review of the prior art and in light of the teachings herein.

BRIEF SUMMARY OF THE INVENTION

These and other problems experienced by hearing impaired individuals are addressed by the system and method of the present invention. The system of the present invention includes a secondary transducer or microphone (or other type of secondary audio source) that acts as an alternative to the primary transducer or microphone in the hearing aid itself. Signals received at the secondary audio source can be transmitted, preferably wirelessly, to the hearing aid as a secondary input.

Examples of secondary audio sources include various forms of head-worn or hand-held directional microphones used by the heavily impaired individual (e.g., an array microphone), audio entertainment systems, telephones, and body-worn microphone transmission systems used by third party talkers (e.g., a microphone worn by friends, companions, colleagues, etc. of the hearing impaired individual).

In order to make such a secondary audio source system easier and more practical to use, however, it is desirable to have a hearing aid system that senses the presence of a desired transmission from the secondary audio source, and that automatically switches from the primary audio source of the hearing aid to the signal being transmitted by the secondary audio source. In other words, the hearing aid system selects either the primary or secondary audio source for transmission into the ear canal of a hearing aid wearer. Such switching or selection may be based on an analysis of the incoming signal from the secondary audio source. For example, the system may switch to or select the secondary audio source if the incoming signal is greater that a predetermined threshold. In either case, when the system switches to the secondary audio source, the primary audio source may be completely switched off, or may instead be simply attenuated by the system.

These and other advantages and novel features of the present invention, as well as details of an illustrated embodiment thereof, will be more fully understood from the following detailed description, drawings and claims.

DETAILED DESCRIPTION OF THE INVENTION

Figure 1:
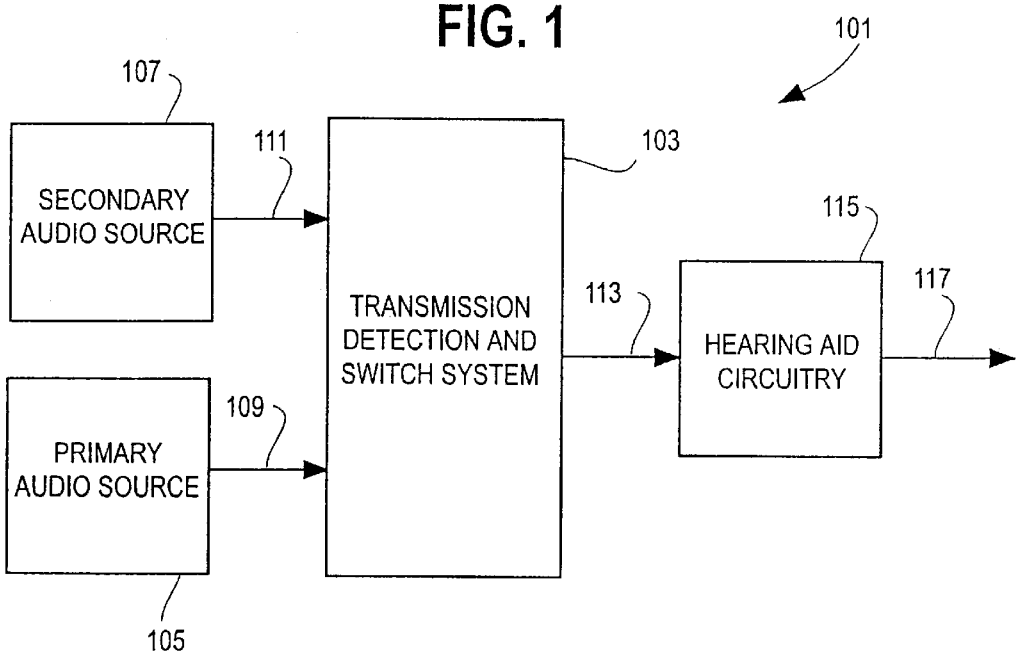
FIG. 1 is a block diagram of the overall hearing improvement system of the present invention.

FIG. 1 is a block diagram of an overall hearing improvement system 101 of the present invention. A transmission detection and switch system 103 receives signals from both a primary audio source 105 and a secondary audio source 107. The primary audio source 105 may be, for example, a directional or omnidirectional microphone located in a hearing aid. The secondary audio source 107 may be, for example, a directional microphone/transmitter mounted on eyeglasses (or otherwise supported by a hearing aid user), a television or stereo transmitter, a telephone or a microphone/transmitter combination under the control of a talker. In one embodiment, the secondary audio source 107 utilizes a wireless transmission scheme for transmission of signals to the transmission detection and switch system 103. In another embodiment, the secondary audio source 107 is wired to the transmission detection and switch system 103.

In operation, the transmission detection and switch system 103, which may or may not be located within the hearing aid, selects one of signals 109 and 111 (from the primary and secondary audio sources 105 and 107, respectively), and feeds the selected signal as an input 113 to hearing aid circuitry 115. Hearing aid circuitry 115, which may be, for example, a hearing aid amplifier and speaker, in turn generates an audio output 117 for transmission into the ear canal of the hearing aid user.

In one embodiment, when the secondary audio source 107 is selected for transmission into the ear canal of the hearing aid user, the primary audio source 105, i.e., the hearing aid microphone, is completely shut off. In this case, the hearing aid user cannot generally hear any audio received by the primary audio source 105. In another embodiment, however, even when the secondary audio source is selected, the primary audio source 105 is not completely shut off. Instead, the primary audio source 105 is only attenuated so that the hearing aid user can still hear background or room sounds when listening to the secondary audio source 107. Attenuation of the primary audio source 105 as such enables the hearing aid user to listen to the secondary audio source 107 while retaining a room sense or orientation that is provided to the hearing aid user by the primary audio source 105.

Figure 2:
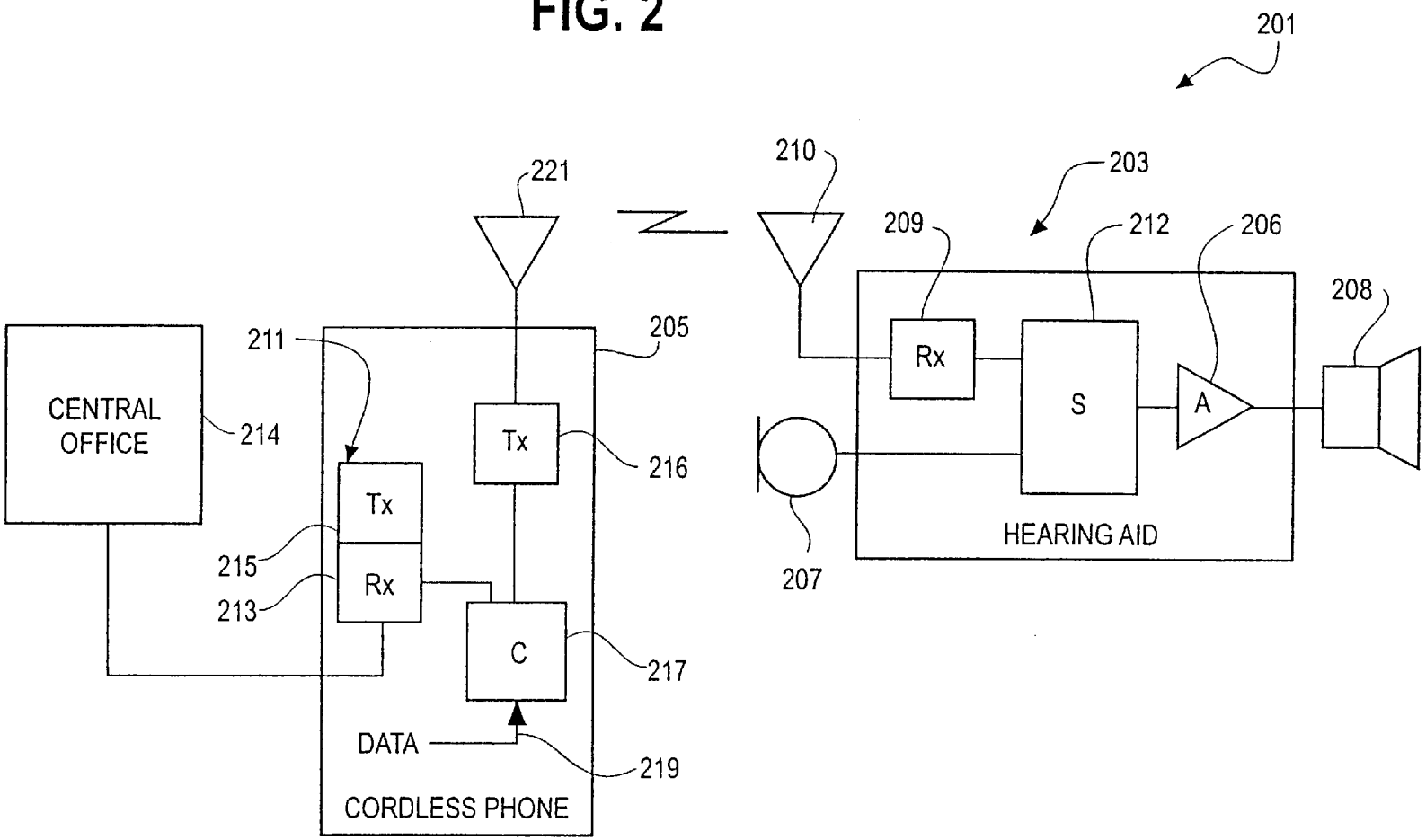
FIG. 2 is a block diagram of a more specific embodiment of an overall hearing improvement system in accordance with the present invention.

FIG. 2 is a block diagram of a more specific embodiment of an overall hearing improvement system in accordance with the present invention. The system 201 comprises a hearing aid 203, which may be one of several types of hearing aids currently available, such as, for example, the BTE, ITE, ITC and CIC hearing aids mentioned above. The hearing aid 203 comprises a housing that incorporates a microphone 207, which may either be a directional microphone, an omni-directional microphone, or a switchable combination of the two. In any case, the microphone 207 acts as a primary audio source for the hearing aid 203.

The hearing aid 203 also comprises a receiver 209 and associated circuitry for receiving wireless signals via an aerial 210. The receiver 209 and aerial 210 combination may be, for example, a radio frequency receiver and antenna or an inductive coil. The hearing aid 203 further comprises circuitry 212 that performs signal detecting, selecting and combining functionality. The circuitry 212 selects either signals received by the hearing aid microphone 207 or by the receiver 209, as discussed more completely herein. The selected signal (or combined signal, if applicable) is next fed to a hearing aid amplifier 206, which amplifies the selected signal, and then to a speaker 208, which converts the selected signal into audio and transmits the audio into the ear canal of a hearing aid user.

In addition to the hearing aid 203, the system 201 of FIG. 2 further comprises a telephone 205, which acts as a secondary audio source for the hearing aid 203. The telephone 205 is hard wired to a traditional telephone network for two-way voice communication via a central office 214. The telephone 205 comprises a typical transceiver 211 that has both a receiver 213 component for receiving voice audio signals from the central office 214 and a transmitter 215 component for transmitting voice audio signals to the central office 214.

The telephone 205 also comprises a second transmitter 216 and associated circuitry, as well as signal combiner circuitry 217 and a data input 219. The transmitter 216 is operatively coupled to the signal combiner circuitry 217, which in turn is operatively coupled to the receiver 213 and the data input 219. Data input 219 may receive data from, for example, a keyboard of the telephone 205 (not shown), memory within the telephone 205, an external computer or the like connected to the telephone 205, or from the central office 214. In any case, such data may be, for example, hearing aid programming information.

The combiner circuitry 217 of the telephone 205 transmits audio signals received by the receiver 213 and/or data signals received at the data input 219, to the transmitter 216. Signals received by the transmitter 216 from the combiner circuitry 217 are in turn transmitted wirelessly to the hearing aid 203 via an aerial 221. The transmitter 216 and aerial 221 combination may similarly be, for example, a radio frequency transmitter and antenna or an inductive coil.

In operation, the telephone 205 is brought into proximity of the ear of a hearing aid user. The circuitry 212 of the hearing aid 203 detects wireless signals being transmitted by the wireless transmission subsystem of the telephone 205. The hearing aid user then, if selection of the wireless signals is applicable, hears directly via the speaker 208 of the hearing aid 203 signals that would otherwise have been picked up via microphone 207 of the hearing aid 203 via a speaker of the telephone 205.

The wireless subsystem of the telephone 205 may be continuously activated, manually activated by a user, or may be automatically activated when the telephone 205 rings, is removed from the base unit, receives voice data, or senses that the telephone is in proximity of the hearing aid 203. In addition, the wireless subsystem of the telephone 205 may also assist the hearing aid user to hear the telephone ring. For example, the wireless scheme may broadcast a higher power signal that can be received by the receiver 209 of the hearing aid 203 for indicating to the wearer that the telephone 205 is ringing.

In any event, as is apparent from the above description, the telephone 205 of the system 201 of FIG. 2 essentially includes two communication subsystems that respectively communicate on two separate and distinct networks, namely the traditional hardwired telephone network and a low powered personal wireless network involving the hearing aid 203.

Figure 3:
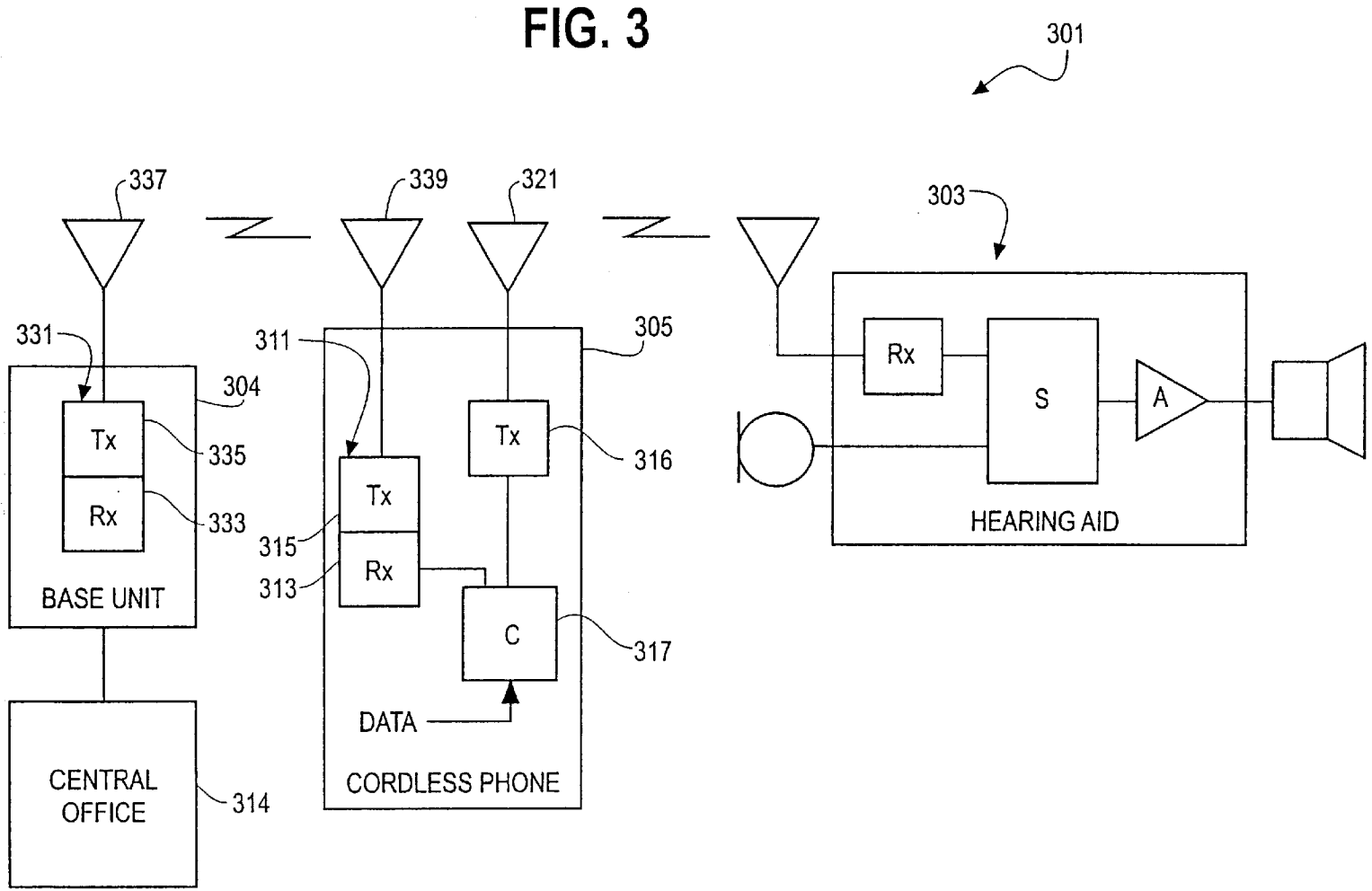
FIG. 3 is a block diagram of another more specific embodiment of an overall hearing improvement system in accordance with the present invention.

FIG. 3 is a block diagram of another more specific embodiment of an overall hearing improvement system in accordance with the present invention. The system 301 of FIG. 3 is similar to the system 201 of FIG. 2, in that hearing aid 303 of FIG. 3 may have the same components and functionality of the hearing aid 203 discussed above with respect to FIG. 2. However, in the system 301 of FIG. 3, the secondary audio source is different.

More specifically, the system 301 of FIG. 3 comprises a cordless telephone 305 rather than a corded telephone as found in FIG. 2. The cordless telephone 305 may have the same component(s) comprising the wireless subsystem for communication with the hearing aid as those found in the corded telephone in FIG. 2. Instead of being hardwired to a central office 314, however, the telephone 305 of FIG. 3 has a second wireless subsystem for communicating with a base unit 304, which itself is hardwired to the central office 314.

The base unit 304 comprises a wireless transceiver 331 that has a receiver 333 and a transmitter 335 component, as well as an aerial 337, which may be, for example, an antenna. The cordless telephone 305 similarly comprises a wireless transceiver 311 that has a receiver 313 component and a transmitter 315 component, as well as an aerial 339, which likewise may be, for example, an antenna. Signals received by the receiver 335 from the central office 314 are transmitted by the transmitter 333 via the aerial 337 to the cordless telephone 305. The receiver 313 of the cordless telephone 305 receives the signals via the aerial 339, which signals are then transmitted to signal combiner circuitry 317 of the cordless telephone 305. The signals are then transmitted via transmitter 316 and aerial 321 of the cordless telephone 305 to the hearing aid 303.

Similar to the telephone 205 of FIG. 2, the telephone 305 of FIG. 3 essentially includes two communication subsystems that respectively communicate on two separate and distinct networks. This time, however, the communication subsystems are both (at least partially) wireless. The telephone 305 communicates on two personal wireless networks, namely a higher powered one within a home or other premises (which in turn is hardwired to the main telephone network), and a lower powered one involving the hearing aid 303. In all other respects, however, the telephone 305 may have the same functionality as that discussed above with respect to telephone 205 of FIG. 2.

Figure 4:
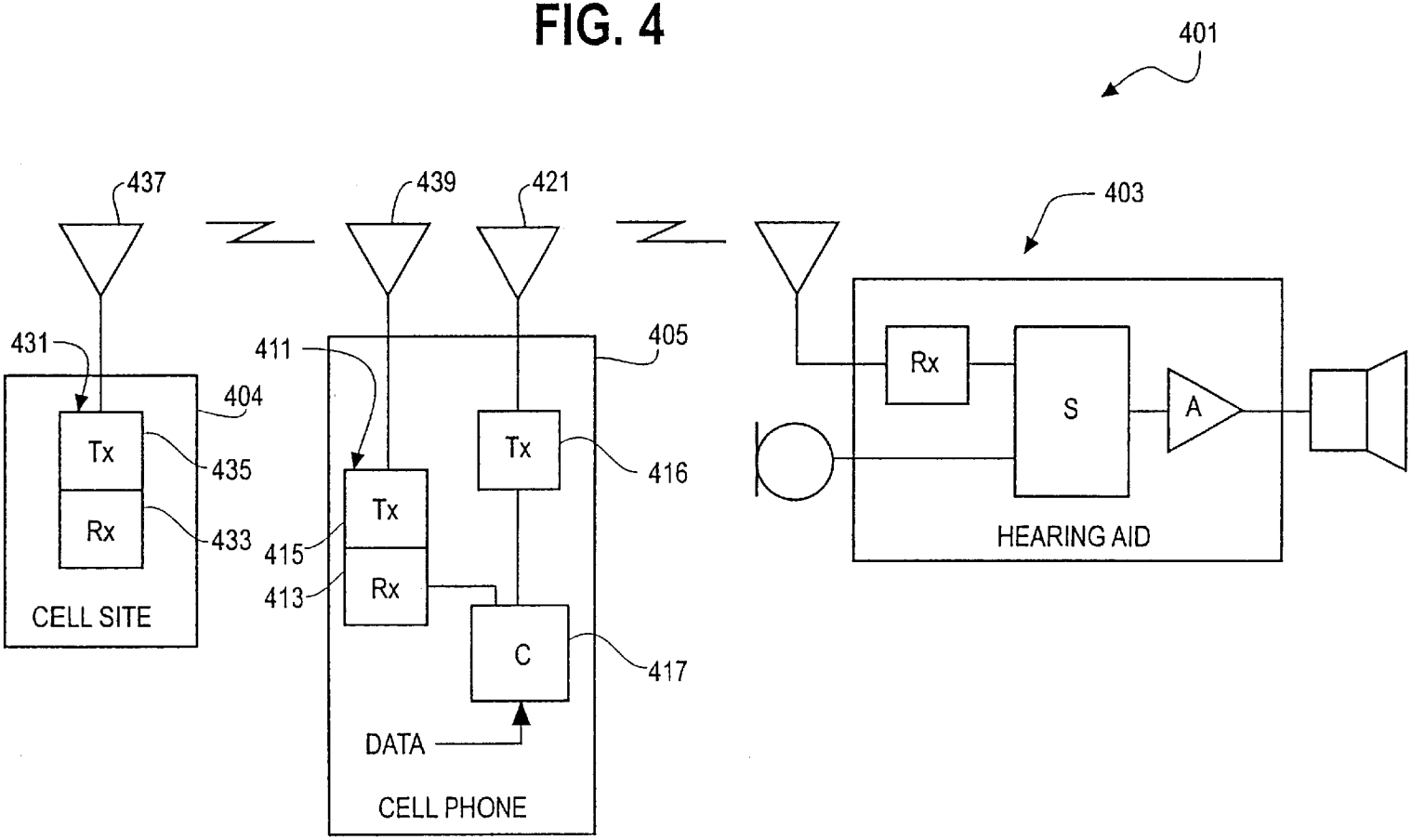
FIG. 4 is a block diagram of a further more specific embodiment of an overall hearing improvement system in accordance with the present invention.

FIG. 4 is a block diagram of a further more specific embodiment of an overall hearing improvement system in accordance with the present invention. The system 401 of FIG. 4 is similar to the system 301 of FIG. 3, in that hearing aid 403 of FIG. 4 may have the same components and functionality of the hearing aid 203 discussed above with respect to FIG. 2. Again, however, in the system 401 of FIG. 4, the secondary audio source is different.

More specifically, in FIG. 4, the secondary audio source is a cellular telephone 405. Like the cordless telephone in FIG. 3, the cellular telephone 405 may have the same component(s) comprising the wireless subsystem for communication with the hearing aid as those found in the corded telephone in FIG. 2. Instead of wirelessly communicating with a base unit that is hardwired to a central office, however, the cellular telephone 405 communicates with a cell site 404 on a wide area cellular network.

The cell site 404 comprises a wireless transceiver 431 that has a receiver 433 and a transmitter 435 component, as well as an aerial 437, which may be, for example, an antenna. The cellular telephone 405 similarly comprises a wireless transceiver 411 that has a receiver 413 component and a transmitter 415 component, as well as an aerial 439, which likewise may be, for example, an antenna. Signals received via the wide area cellular network by the receiver 434 433 of the cell site 404 are transmitted by the transmitter 435 via the aerial 437 to the cellular telephone 405. The receiver 413 of the cellular telephone 405 receives the signals via the aerial 439, which signals are then transmitted to signal combiner circuitry 417 of the cellular telephone 405. The signals are then transmitted via transmitter 416 and aerial 421 of the cellular telephone 405 to the hearing aid 403.

Similar to the telephones 205 and 305 of FIGS. 2 and 3, respectively, the telephone 405 of FIG. 4 essentially includes two communication subsystems that respectively communicate on two separate and distinct networks. This time, however, the communication subsystems are both entirely wireless. The cellular telephone 405 not only communicates on a high-powered wide area cellular network, but also a lower powered one involving the hearing aid 403. In all other respects, however, the telephone 405 may have the same functionality as that discussed above with respect to telephone 205 of FIG. 2.

Figure 5:
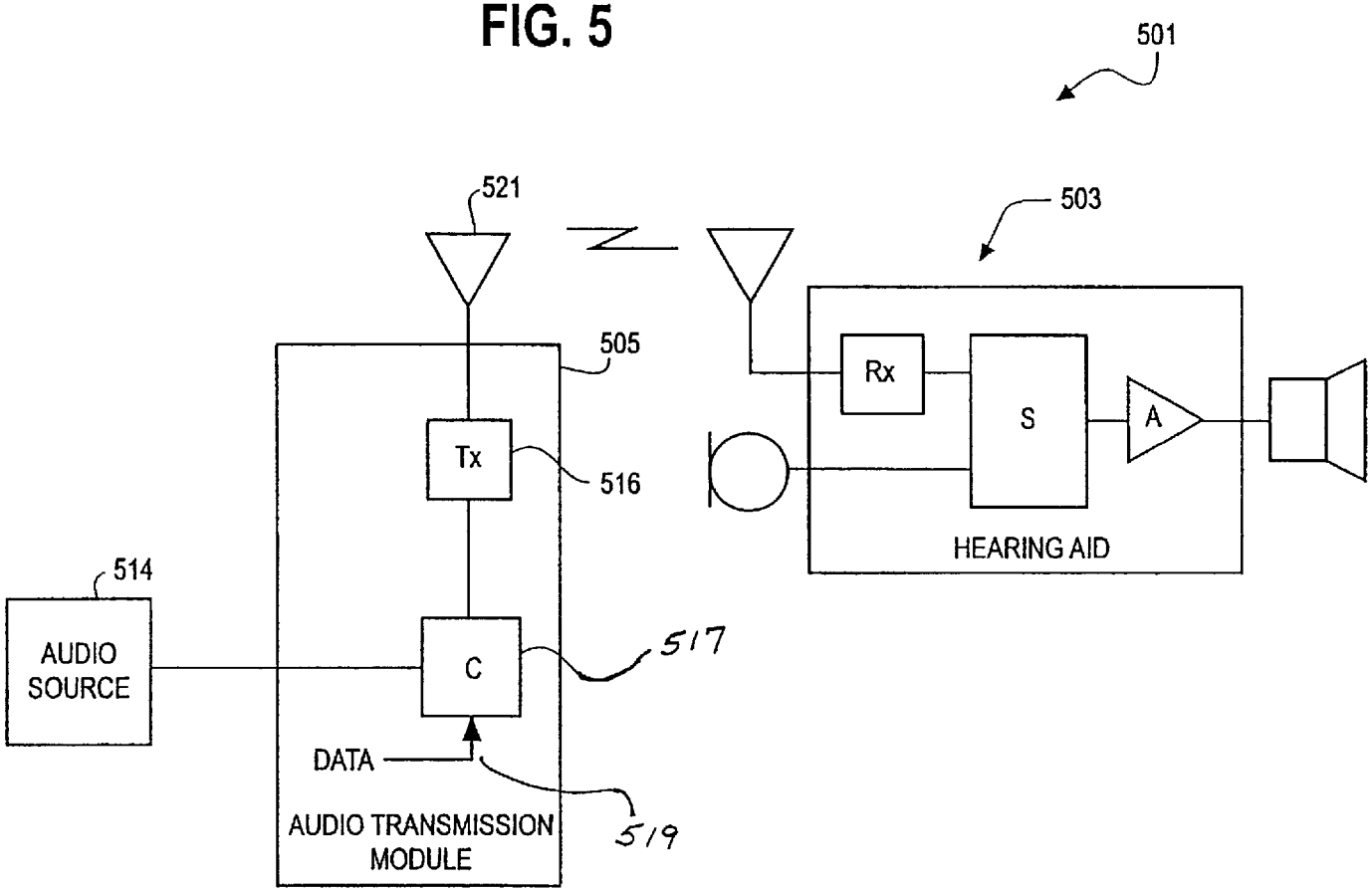
FIG. 5 is a block diagram of a still further more specific embodiment of an overall hearing improvement system in accordance with the present invention.

FIG. 5 is a block diagram of a still further more specific embodiment of an overall hearing improvement system in accordance with the present invention. The system 501 of FIG. 5 is similar to the systems 301 of FIG. 3 and 401 of FIG. 4, in that hearing aid 503 of FIG. 5 may have the same components and functionality of the hearing aid 203 discussed above with respect to FIG. 2. In the system 501 of FIG. 5, however, the secondary audio source is different altogether.

More specifically, the secondary audio source of FIG. 5 is an audio transmission module 505. The audio transmission module comprises signal combiner circuitry 517 that is hardwired to an audio source 514. The audio source 514 may be, for example, a stereo or other home entertainment system, movie audio at a movie theatre, car audio, etc. The combiner circuitry 517 of the module 505 transmits audio signals received by the receiver from the audio source 514 and/or data signals received at the data input 519, to the transmitter 516. Signals received by the transmitter 516 from the combiner circuitry 517 are in turn transmitted wirelessly to the hearing aid 503 via an aerial 521. The transmitter 516 and aerial 521 combination may be, for example, a radio frequency transmitter and antenna or an inductive coil.

The audio transmission module 505 may, for example, be located in the seat back of a chair proximate the head position of a person sitting in the chair or in a head-rest of a chair. In operation, the hearing aid user brings the user's ear into proximity of the transmission module 505. The circuitry of the hearing aid 503 detects wireless signals being transmitted by the audio transmission module 505. The hearing aid user then, if selection of the wireless signals is applicable, hears directly from the audio source 514 signals that would otherwise have been picked up via microphone of the hearing aid 503 from audio in the listening room.

The wireless subsystem of the audio transmission module 505 may be continuously activated, manually activated by a user, or may be automatically activated when the module 505 receives audio data or senses that the hearing aid 503 has been brought in proximity of the module 505.

Figure 6:
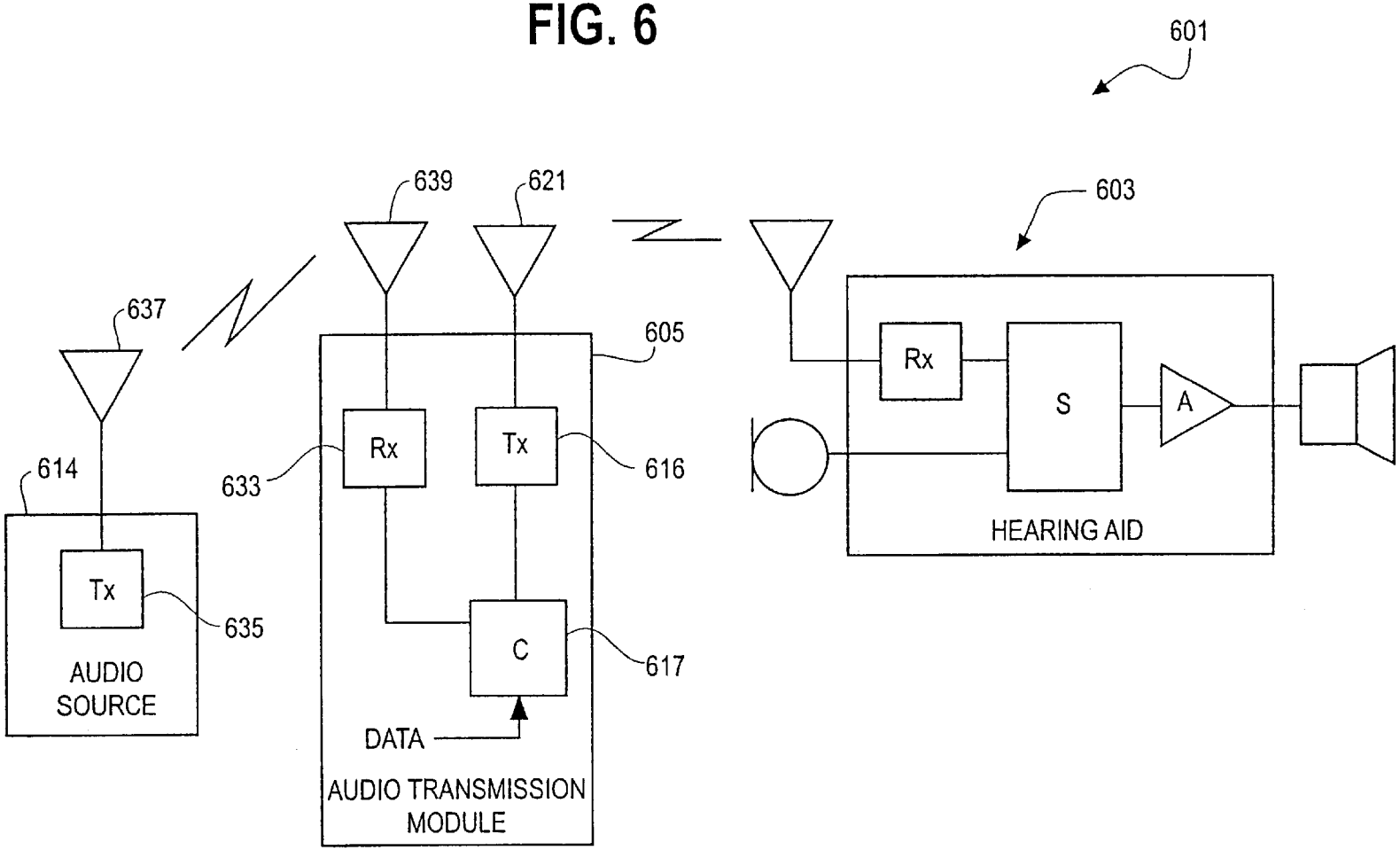
FIG. 6 is a block diagram of yet another more specific embodiment of an overall hearing improvement system in accordance with the present invention.

FIG. 6 is a block diagram of yet another more specific embodiment of an overall hearing improvement system in accordance with the present invention. The system 601 of FIG. 6 is similar to the system 501 of FIG. 5, in that hearing aid 603 of FIG. 6 may have the same components and functionality of the hearing aid 203 discussed above with respect to FIG. 2. In addition, the secondary audio source of FIG. 6 is an audio transmission module 605, similar to audio transmission module 505 of FIG. 5. This time, however, the audio transmission module 605 is not hard wired to the audio source. Instead, communication between the audio source 614 and audio transmission module 605 is wireless.

The audio transmission module 605 may have the same component(s) comprising the wireless subsystem for communication with the hearing aid as those found in the audio transmission module 505 of FIG. 5. The audio transmission module 605, however, further comprises a receiver 633 component and an aerial 639, which may be, for example, an antenna, for wirelessly receiving audio signals from the audio source 614. The audio source 614 comprises a transmitter 635 and an aerial 637, which similarly may be, for example, an antenna.

In operation, the audio source 614 transmits audio signals via the aerial 637 to the audio transmission module 605. Signals received by the receiver 633 of the audio transmission module 605 from the audio source 614 are transmitted to combiner circuitry 617, which in turn forwards the audio signals to the transmitter 616. Those signals are in turn transmitted wirelessly to the hearing aid 603 via the aerial 621. Again, the transmitter 616 and aerial 621 combination may be, for example, a radio frequency transmitter and antenna or an inductive coil.

Because the audio transmission module 605 is wireless (and thus need not be wired to the audio source 614), the audio transmission module 605 may be located just about anywhere in a room or premises that is within range of the audio source 614. In addition, the audio transmission module 605, like the cordless telephone of FIG. 3, operates on two separate personal wireless networks, a higher powered one involving the audio source 614 and a lower powered one involving the hearing aid 603. Aside from its wireless receipt of signals from the audio source 614, however, the audio transmission module 605 may operate in the same manner as the audio transmission module 505 of FIG. 5.

Figure 7:
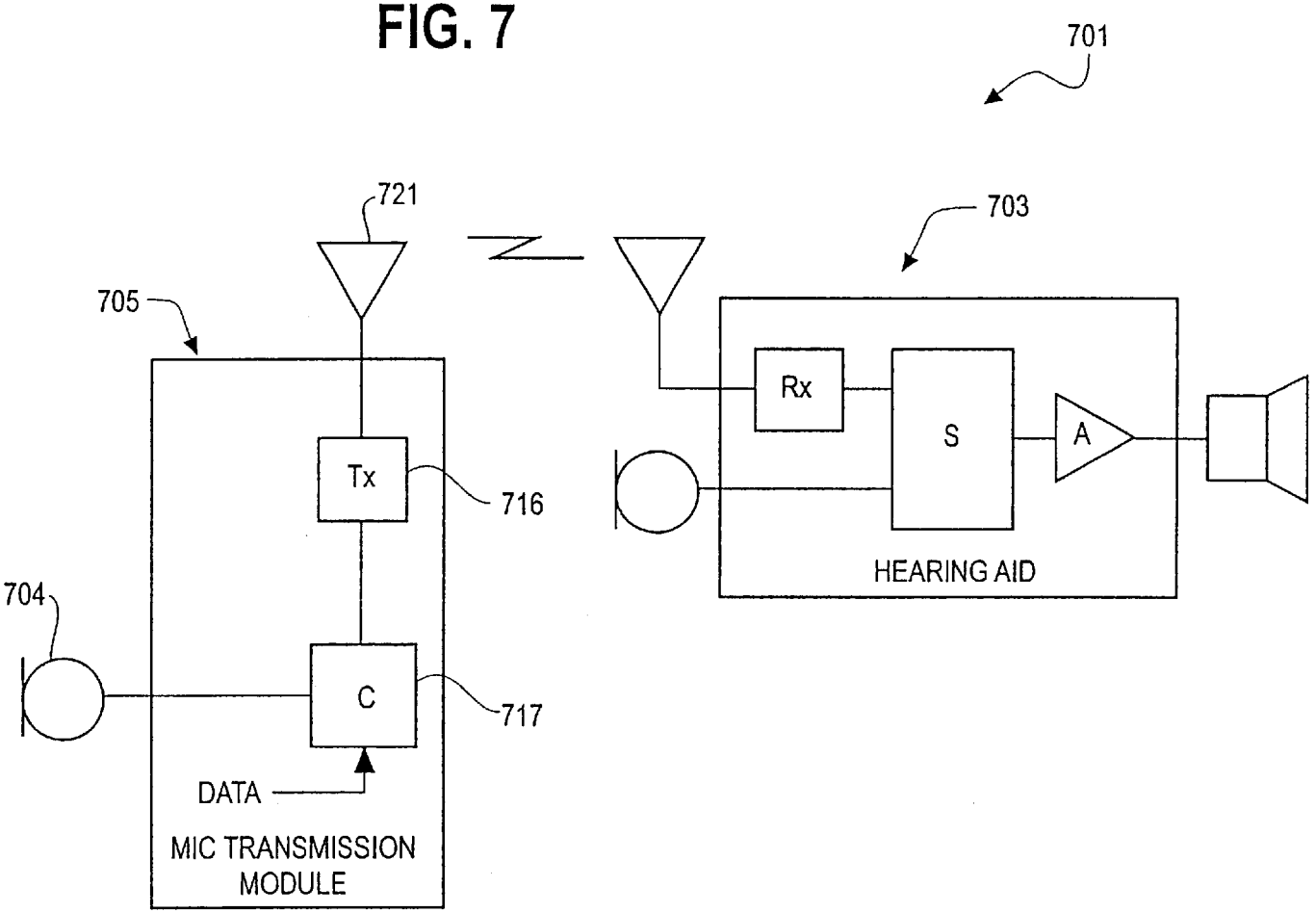
FIG. 7 is a block diagram of still another more specific embodiment of an overall hearing improvement system in accordance with the present invention.

FIG. 7 is a block diagram of still another more specific embodiment of an overall hearing improvement system in accordance with the present invention. The system 701 of FIG. 7 is similar to those discussed above, in that hearing aid 703 of FIG. 7 may have the same components and functionality of the hearing aid 203 discussed above with respect to FIG. 2. In addition, the secondary audio source of FIG. 7 is an audio transmission module similar to audio transmission modules 505 and 605 of FIGS. 5 and 6, respectively. In FIG. 7, however, the audio transmission module is a microphone transmission module 705. Instead of receiving audio signals from an audio source, such as a home entertainment system, the microphone transmission module 705 picks up sound from a microphone 704 that is distinct from the microphone of the hearing aid 703. In all other respects, the audio transmission module 705 may operate in the same manner as, and be positioned in the same environments as, the audio transmission module 505 of FIG. 5.

The microphone 704 of the microphone transmission module 705 may be, for example, a directional microphone array or other directional microphone. The microphone transmission module 705 may be worn or otherwise supported by the hearing aid user, or even a talker if the talker is within range for wireless transmission between the microphone transmission module 705 and the hearing aid 703. The microphone transmission module 705 may have the same component(s) comprising the wireless subsystem for communication with the hearing aid as those found in the audio transmission module 505 of FIG. 5. In addition, the microphone transmission module 705 may be continuously activated, manually activated by a user, or may be automatically activated when the module 705 receives audio transmissions or senses that the hearing aid 703 has been brought in proximity of the module 705 (or vice versa).

In operation, the microphone 704 picks up audio and converts it into audio signals. The signals are then transmitted to combiner circuitry 717, which in turn forwards the audio signals to the transmitter 716. Those signals are in turn transmitted wirelessly to the hearing aid 703 via the aerial 721. As previously, the transmitter 716 and aerial 721 combination may be, for example, a radio frequency transmitter and antenna or an inductive coil.

Figure 8:
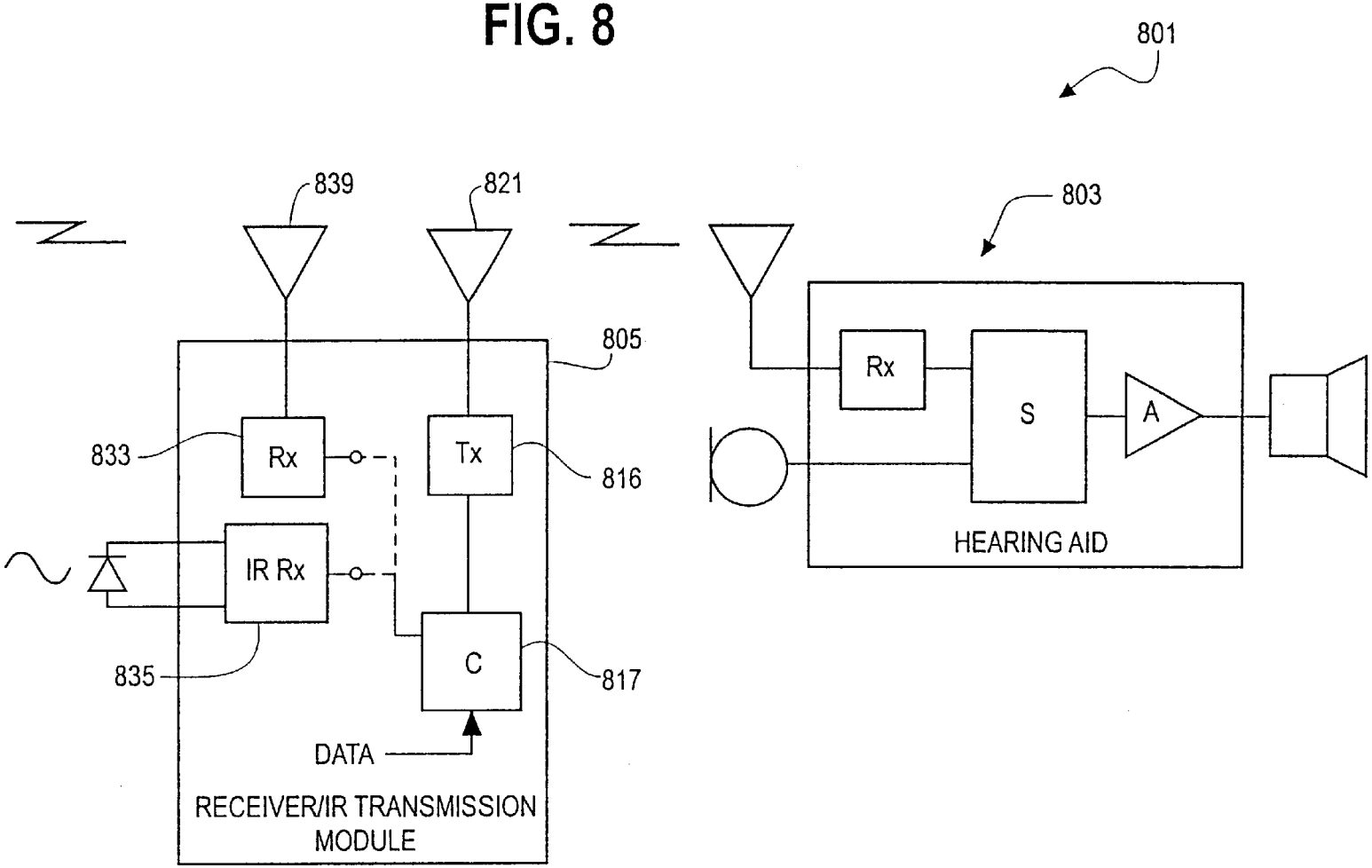
FIG. 8 is a block diagram of a further more specific embodiment of an overall hearing improvement system in accordance with the present invention.

FIG. 8 is a block diagram of a further more specific embodiment of an overall hearing improvement system in accordance with the present invention. The system 801 of FIG. 8 is similar to the system 701 of FIG. 7. In FIG. 8, however, the transmission module 805 receives wireless audio signals from an external audio source, which may be any type of audio source including a "remote" microphone. The transmission module 805 may have the same component(s) comprising the wireless subsystem for communication with the hearing aid as those found in the audio transmission module 505 of FIG. 5. In addition, the audio transmission module 805 may generally operate in the same manner as the audio transmission module 505 of FIG. 5.

The transmission module 805 further comprises a receiver 833 component and/or an infrared receiver 835 component. The transmission module 805 may receive audio signals via the receiver 833 and the aerial 839, which may be, for example, an antenna. Alternatively, the transmission module 805 may receive infrared audio signals via the infrared receiver 835. The signals are then transmitted to combiner circuitry 817, which in turn forwards the audio signals to the transmitter 816. Those signals are in turn transmitted wirelessly to the hearing aid 803 via the aerial 821. As with other embodiments, the transmitter 816 and aerial 821 combination may be, for example, a radio frequency transmitter and antenna or an inductive coil.

Figure 9:
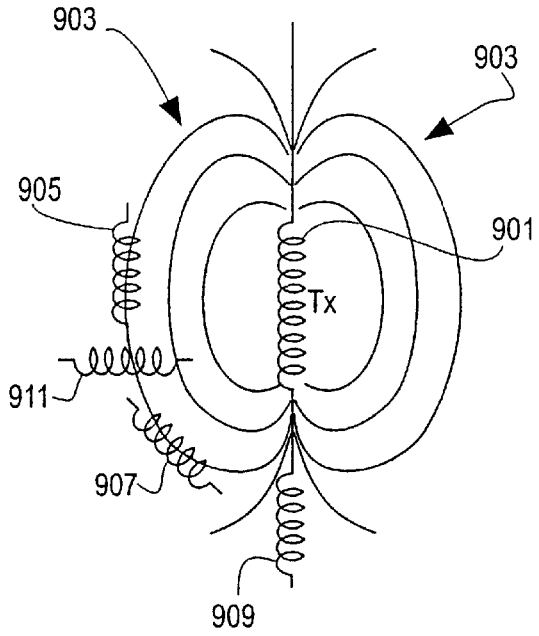
FIG. 9 illustrates a component orientation guideline for wireless communication between a secondary audio source and a hearing aid in accordance with the present invention.

FIG. 9 illustrates a component orientation guideline for wireless communication between a secondary audio source and a hearing aid in accordance with the present invention. FIG. 9 specifically illustrates a guideline for the case of inductive wireless transmission. A transmitting coil 901 is shown surrounded by a magnetic field 903. Location of the receiving coil at positions 905 and 909 relative to transmitting coil 901 are advantageous. Locations such as position 907 generally aligned with the magnetic field 903 are also acceptable. Locations such as position 911 aligned perpendicularly to the magnetic field should be avoided, however, due to the null located at such positions.

Figure 10:
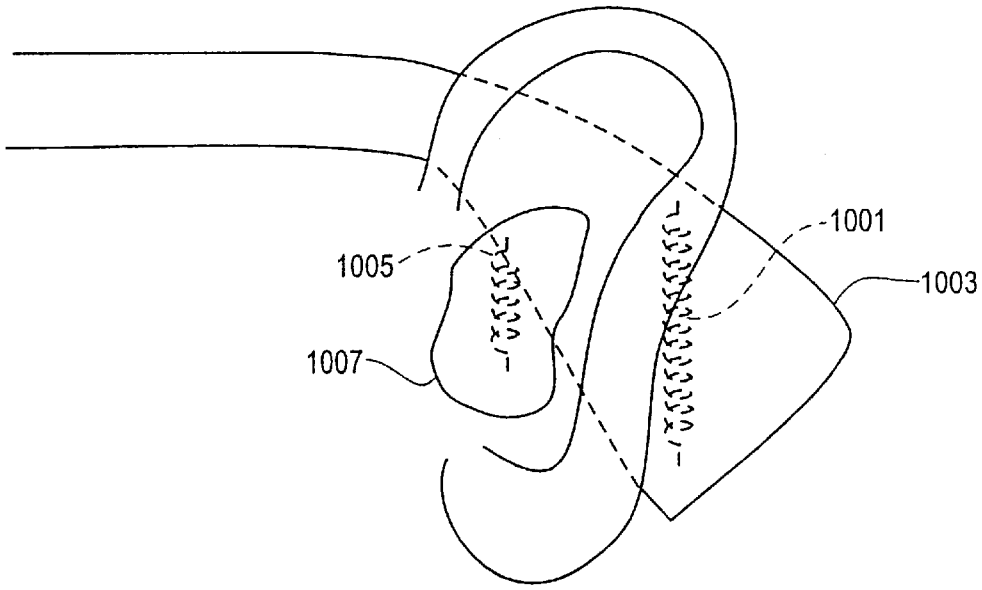
FIG. 10 illustrates an advantageous positioning of a transmitting coil relative to a receiving coil based on the guidelines of FIG. 9.

FIG. 10 illustrates an advantageous positioning of a transmitting coil relative to a receiving coil based on the guidelines of FIG. 9. Transmitting coil 1001, located in or on a glasses frame 1003, is positioned parallel and to the side of a receiving coil 1005 located within a hearing aid 1007.

Figure 11:
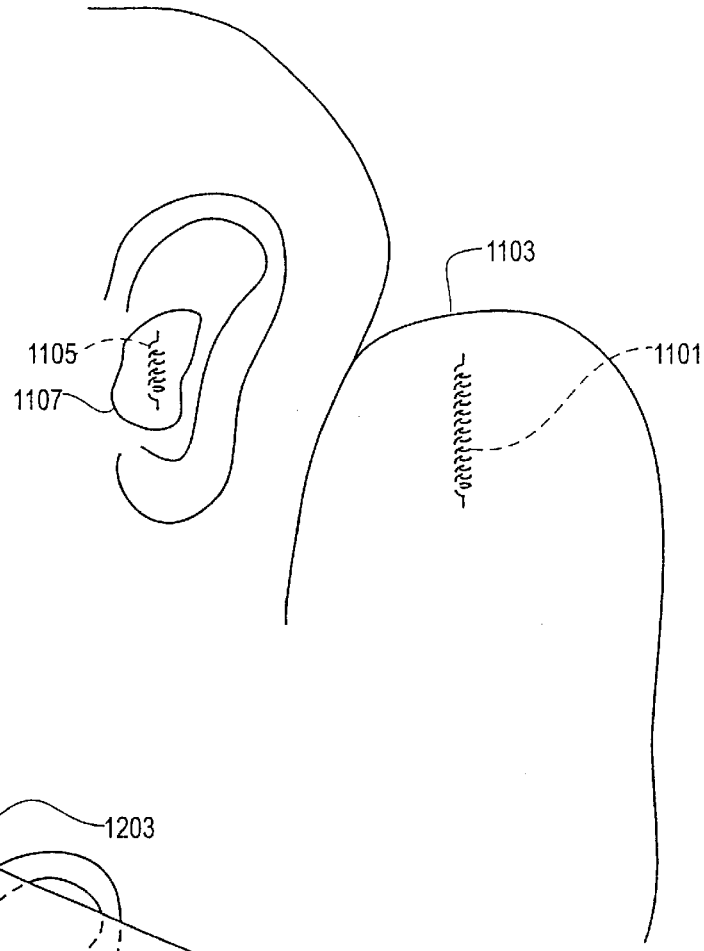
FIG. 11 illustrates an advantageous positioning of a transmitting coil relative to a receiving coil in another embodiment based on the guidelines of FIG. 9.

FIG. 11 illustrates an advantageous positioning of a transmitting coil relative to a receiving coil in another embodiment based on the guidelines of FIG. 9. Transmitting coil 1101, located in seat back or headrest 1103, is similarly positioned parallel and to the side of a receiving coil 1105 located within a hearing aid 1107 when the hearing aid user is in a seated position. This relative positioning will be generally maintained with normal left-right head movements.

Figure 12:
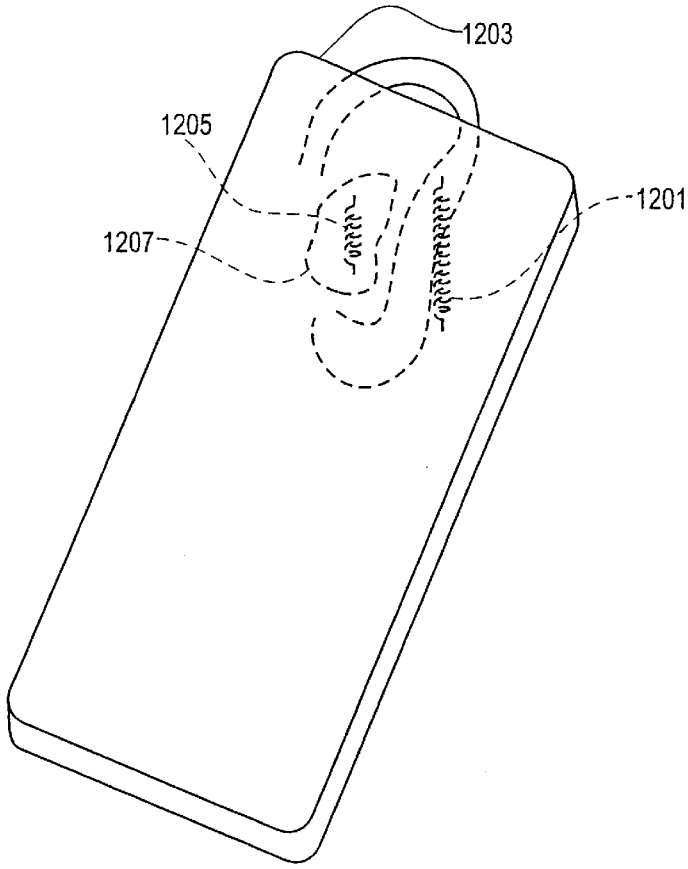
FIG. 12 illustrates an advantageous positioning of a transmitting coil relative to a receiving coil in yet another embodiment based on the guidelines of FIG. 9.

FIG. 12 illustrates an advantageous positioning of a transmitting coil relative to a receiving coil in yet another embodiment based on the guidelines of FIG. 9. Transmitting coil 1201, located in telephone 1203, is again similarly positioned parallel and to the side of a receiving coil 1205 located within a hearing aid 1207 when the phone is located proximate the ear in a typical manner.

Figure 13:
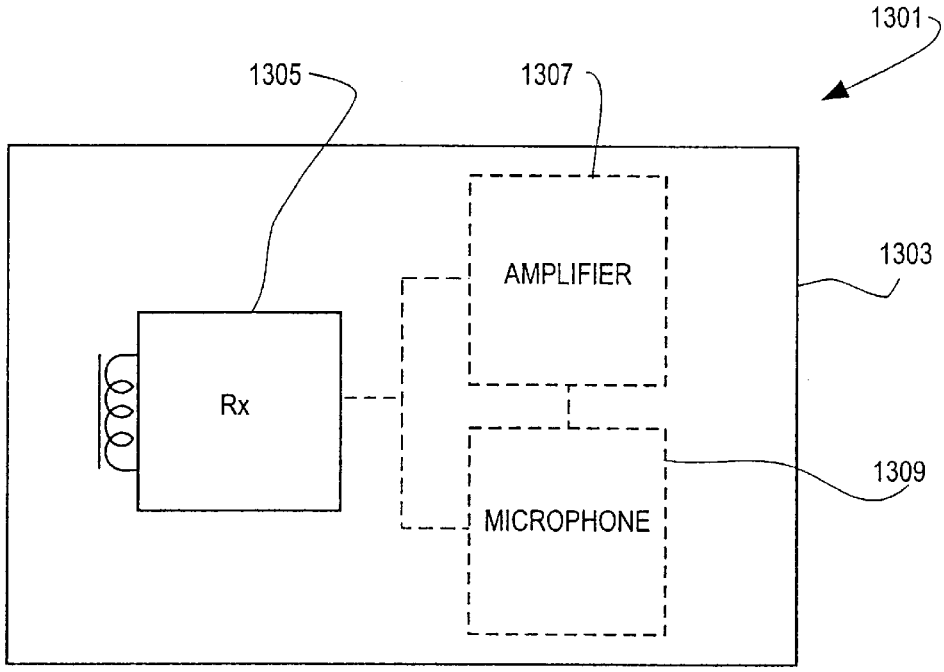
FIG. 13 illustrates a block diagram of a module for incorporation with a hearing aid.

Certain components used by the hearing improvement system of the present invention may be integrated into a single module that may be manufactured/assembled separately and simply incorporated into or with the hearing aids or secondary audio sources contemplated by the present invention. For example, FIG. 13 illustrates a block diagram of such a module for incorporation with a hearing aid. Module 1301 comprises a hearing aid faceplate 1303 that incorporates a receiver component 1305 having an inductive coil. The faceplate 1303 may also incorporate a hearing aid amplifier 1307 and/or a hearing aid microphone 1309 operatively coupled to the receiver component 1305. The module 1301 may be pre-assembled and sold as a unit to hearing aid manufacturers or sellers who simply install the faceplate 1303 onto a hearing aid shell, and connect the appropriate components. Alternatively, the components 1305, 1307 and 1309 may be integrated into a module that does not include the faceplate 1303 such as, for example, for use with BTE type hearing aids or other types of listening devices.

Figure 14A:
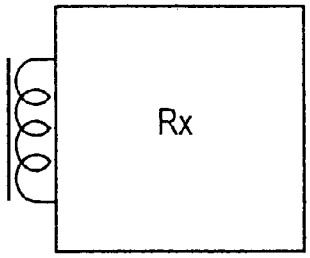
FIGS. 14A, 14B and 14C illustrate block diagrams for different potential modules for insertion into or incorporation with a hearing aid.
Figure 14B:
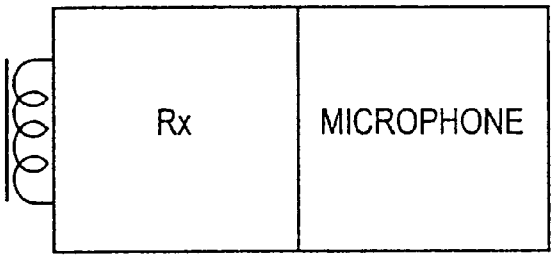
Figure 14C:
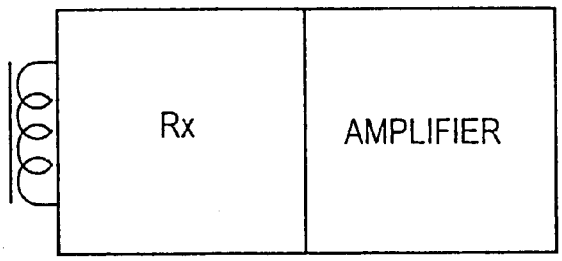

FIGS. 14A, 14B and 14C illustrate block diagrams for different potential modules for insertion into or incorporation with a hearing aid. FIG. 14A shows a module that is simply comprised of a receiver component having an inductive coil or other type of antenna. FIG. 14B shows a module that likewise has a receiver component having an inductive coil (or other type of antenna), as well as an integrated microphone component. FIG. 14C shows a module that likewise has a receiver component having an inductive coil (or other type of antenna), as well as an integrated amplifier component.

Like the module(s) of FIG. 13, the modules of FIG. 14 may be pre-assembled and sold as a unit to hearing aid or other manufacturers or sellers who simply install the module into the hearing aid or other device and connect the appropriate components.

Figure 15A:
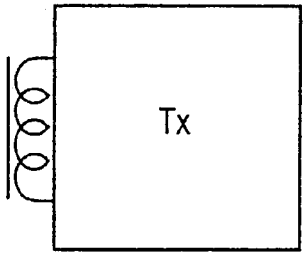
FIGS. 15A, 15B and 15C illustrate block diagrams for different potential modules for insertion into or incorporation with a secondary audio source.
Figure 15B:
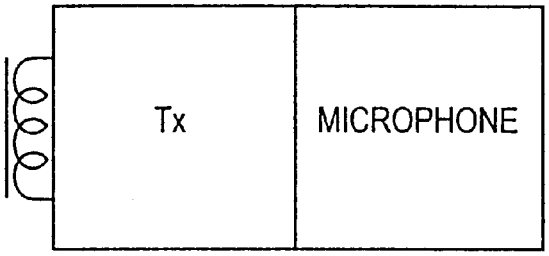
Figure 15C:
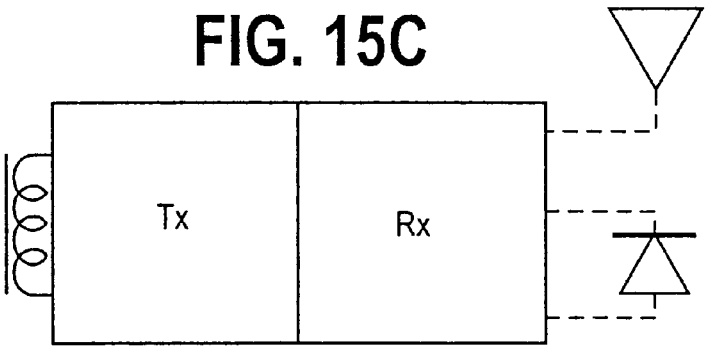

FIGS. 15A, 15B and 15C illustrate block diagrams for different potential modules for insertion into or incorporation with a secondary audio source. FIG. 15A shows a module that is simply comprised of a transmitter component having an inductive coil or other type of antenna. FIG. 15B shows a module that likewise has a transmitter component having an inductive coil (or other type of antenna), as well as an integrated microphone component. FIG. 15C shows a module that has a receiver component, in addition to a transmitter component having an inductive coil (or other type of antenna). These modules may be pre-assembled and sold as a unit to manufacturers or sellers of secondary audio sources who simply install the module into the secondary audio source and connect the appropriate components.

Figure 16:
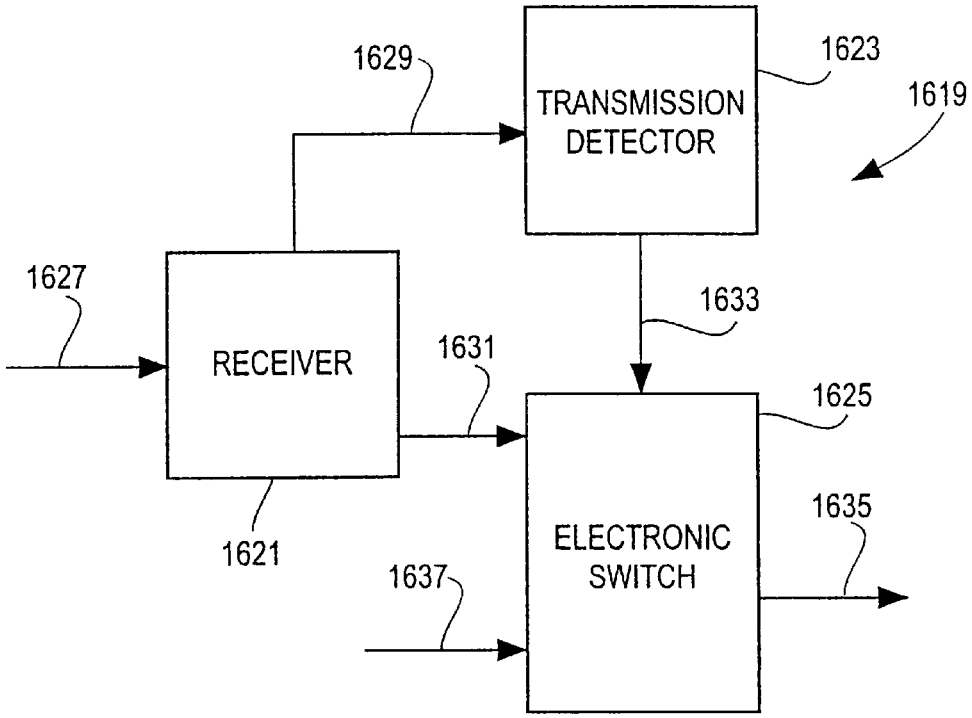
FIG. 16 is a block diagram of one embodiment of a transmission detection and switch system of the present invention.

FIG. 16 is a block diagram of one embodiment of the transmission detection and switch system of the present invention. A transmission detection and switch system 1619, may comprise three basic components, a receiver 1621, a transmission detector 1623 and an electronic switch 1625. The receiver 1621 receives an input signal 1627 from a secondary audio source (not shown). Upon receipt of the input signal 1627 the receiver 1621 generates a detector input signal 1629, as well as an audio output signal 1631 representative of the input signal 1627. The transmission detector 1623 receives the detector input signal 1629, and generates in response a control signal 1633 for the electronic switch 1625. The electronic switch 1625 is controlled by the status of the control signal 1633.

More specifically, for example, if the transmission detector 1623 determines from the detector input signal 1629 that the input signal 1627 represents a desired transmission (e.g., a signal above a certain threshold value), the detector 1623 indicates to the electronic switch 1625, using control signal 1633, that a signal is present. The electronic switch 1625 in turn selects audio output 1631 (representative of the input signal 1627 from the secondary audio source) and provides the audio output 1631 as signal 1635 to hearing aid or other type of circuitry (not shown).

If, on the other hand, the transmission detector 1623 determines from the detector input signal 1629 that the input signal 1629 is not representative of a desired signal (e.g., below a certain threshold value), the detector 1623 indicates to the electronic switch 1625, again using control signal 1633, that no signal is present. The switch then instead selects audio output signal 1637 from the primary audio source (e.g., a hearing aid microphone), and provides the audio output signal 1637 as signal 1635 to the hearing aid or other type of circuitry (not shown).

Figure 17:
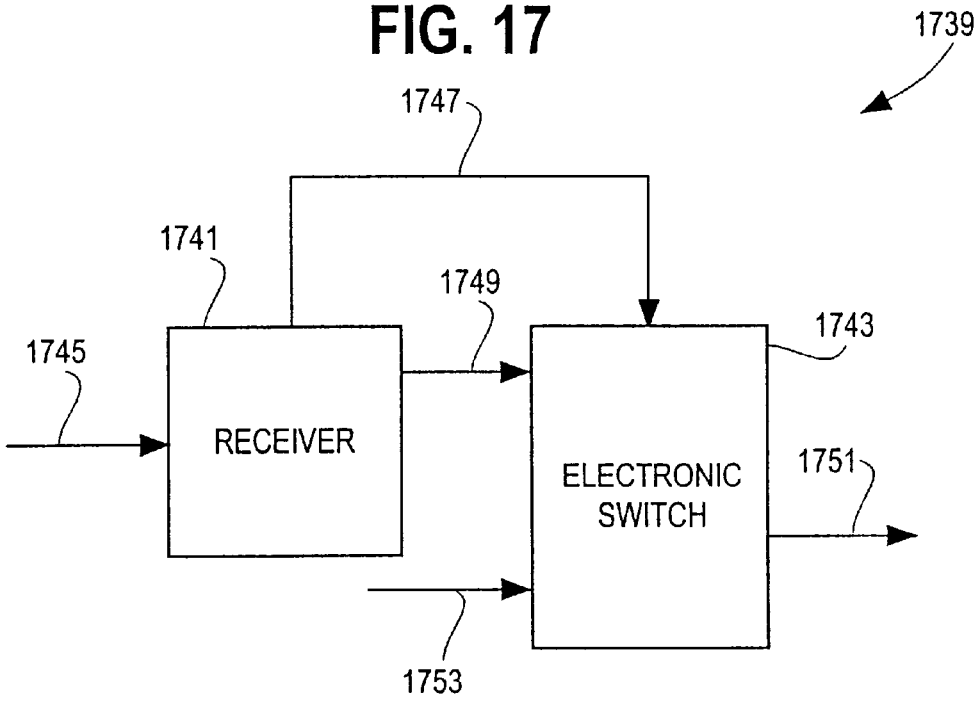
FIG. 17 is a block diagram of another embodiment of a transmission detection and switch system of the present invention.

FIG. 17 is a block diagram of another embodiment of the transmission detection and switch system of the present invention. A transmission detection and switch system 1739 may comprise a receiver 1741 and an electronic switch 1743. The receiver 1741 receives an input signal 1745 from a secondary audio source (not shown). If the input signal 1745 is a desired signal, then receiver 1741 generates a control signal 1747 for the electronic switch 1743. If the input signal 1745 is not a desired signal, then no control signal is generated by the receiver 1741. In either case, the desirability of the signal may be determined by, for example, the receiver 1741 or circuitry associated therewith.

If the electronic switch 1743 receives the control signal 1747 from the receiver 1741, the electronic switch selects receiver output signal 1749, which is an audio output signal representative of input signal 1745 from the secondary audio source (not shown), and provides receiver output signal 1749 as signal 1751 to hearing aid circuitry (not shown).

If, on the other hand, the electronic switch 1743 does not receive the control signal 1747 from the receiver 1741, then the electronic switch selects audio output signal 1753 from the primary audio source (e.g., a hearing aid microphone), and provides the audio output signal 1753 as signal 1751 to the hearing aid circuitry (not shown).

Figure 18:
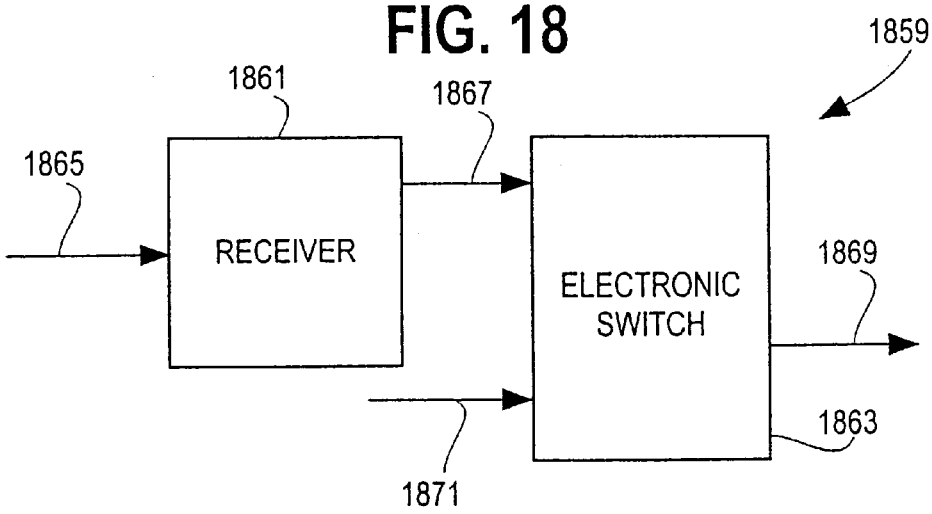
FIG. 18 is a block diagram of a further embodiment of a transmission detection and switch system of the present invention.

FIG. 18 is a block diagram of a further embodiment of the transmission detection and switch system of the present invention. A transmission detection and switch system 1859 may comprise a receiver 1861 and an electronic switch 1863. The receiver 1861 receives an input signal 1865 from a secondary audio source (not shown), and generates an audio output signal 1867 representative of the input signal 1865 for transmission to electronic switch 1863. The electronic switch 1863 receives the audio output signal 1867, and, if it is determined that the audio output signal 1867 is a desired signal, the electronic switch 1863 provides the audio output signal 1867 as signal 1869 to hearing aid circuitry (not shown). If, on the other hand, it is determined that the audio output signal 1867 is not a desired signal, the electronic switch 1863 provides audio output signal 1871 as signal 1869 to the hearing aid circuitry (not shown). In either case, the desirability of the signal 1867 may be determined by the electronic switch 1863 or circuitry associated therewith.

Figure 19:
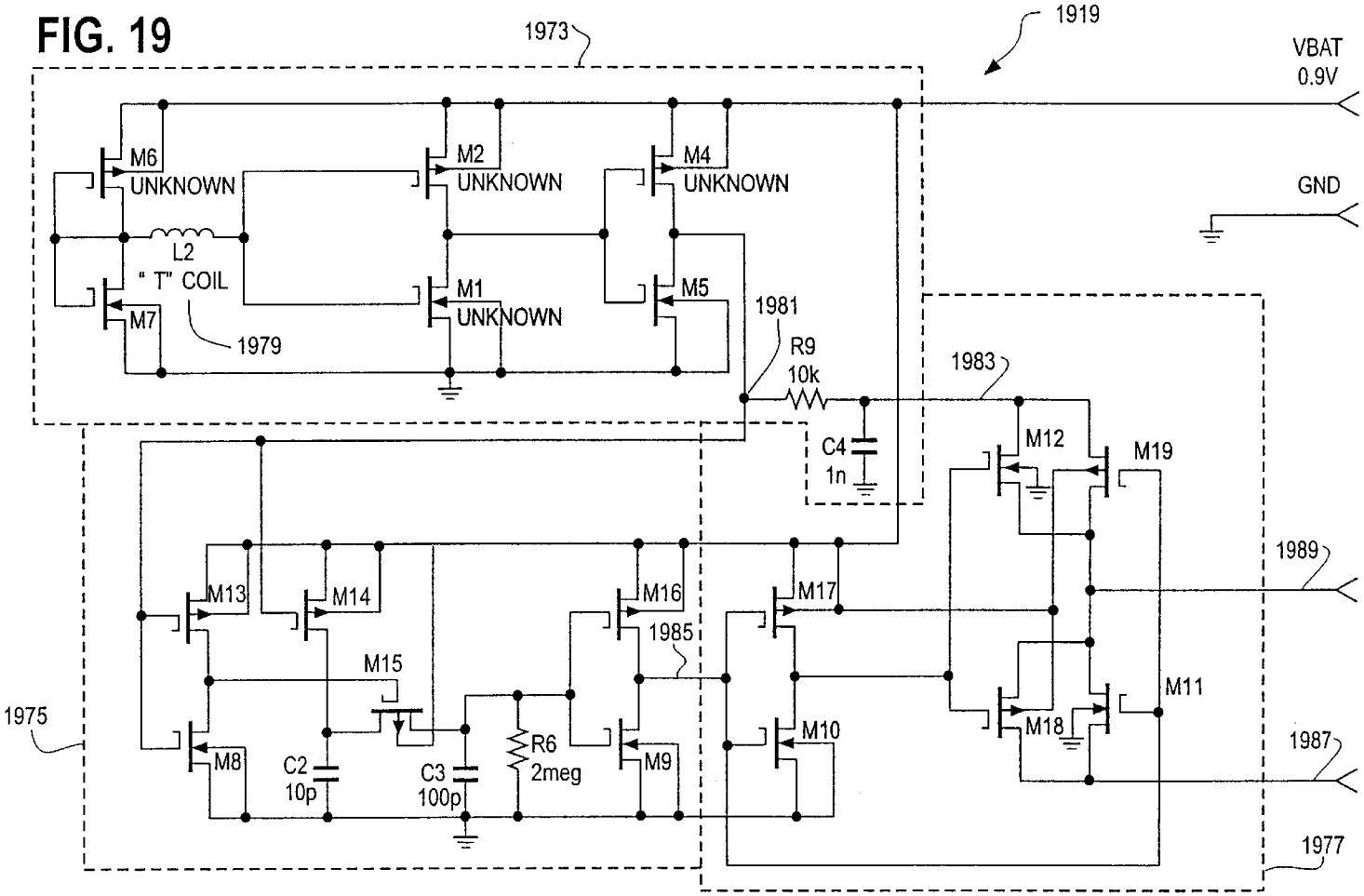
FIG. 19 illustrates one specific circuit implementation of the transmission detection and switch system embodiment of FIG. 16.

FIG. 19 illustrates one specific circuit implementation of the transmission detection and switch system embodiment of FIG. 16. System 1919 comprises a Pulse Width Modulation (PWM) wireless type receiver, a carrier transmission detector and a switch, and is designed to work at a carrier frequency of approximately 100 kHz. The receiver, carrier transmission detector and switch are shown in FIG. 19 by blocks 1973, 1975 and 1977, respectively.

Input to the receiver of block 1973 from the secondary audio source is derived from "T" Coil L2 (illustrated by reference numeral 1979 in FIG. 19). Also in the receiver of block 1973, components M1/M2 and M4/M5 comprise a two-stage amplifier biased by components M6/M7. The output 1981 of the receiver of block 1973, which output represents an un-demodulated 100 kHz carrier signal, is filtered using a single pole at 10 kHz (low pass) filter to produce a demodulated signal 1983 (i.e., a demodulation of the 100 kHz PWM transmission signal).

As mentioned above, the carrier transmission detector is shown in FIG. 19 by block 1975. The output 1981 of the receiver of block 1973, which output, as mentioned above, represents an un-demodulated 100 kHz carrier signal, is "charged pumped/integrated" by components M8, M13, M14, M15, C2, C3, R6 and comparator M9/M16 of the carrier transmission detector of block 1975 to perform a carrier detect function with a nominal 50 kHz threshold detection frequency. The output 1985 of comparator M9/M16 drives the switch, which, as mentioned above, is shown in block 1977.

The switch in block 1977 is comprised of components M10, M11, M12, M17, M18 and M19. When the carrier frequency as determined at output 1985 is greater than 50 kHz, the switch selects signal 1983, representing the audio output of the receiver (from the secondary audio source). When the carrier frequency as determined at output 1985 is not greater than 50 kHz, the switch selects signal 1987, representing the output of the primary audio source. In either case, the selected signal is connected to output 1989, the output of the electronic switch, which in turn is connected to hearing aid circuitry.

It should be understood that, while a specific embodiment is shown in FIG. 19, numerous circuit embodiments may be implemented to carry out the general functionality of FIG. 16, as well as that of FIGS. 17 and 18. In addition, digital signal processing may also be used to carry out such functionality.

Figure 20:
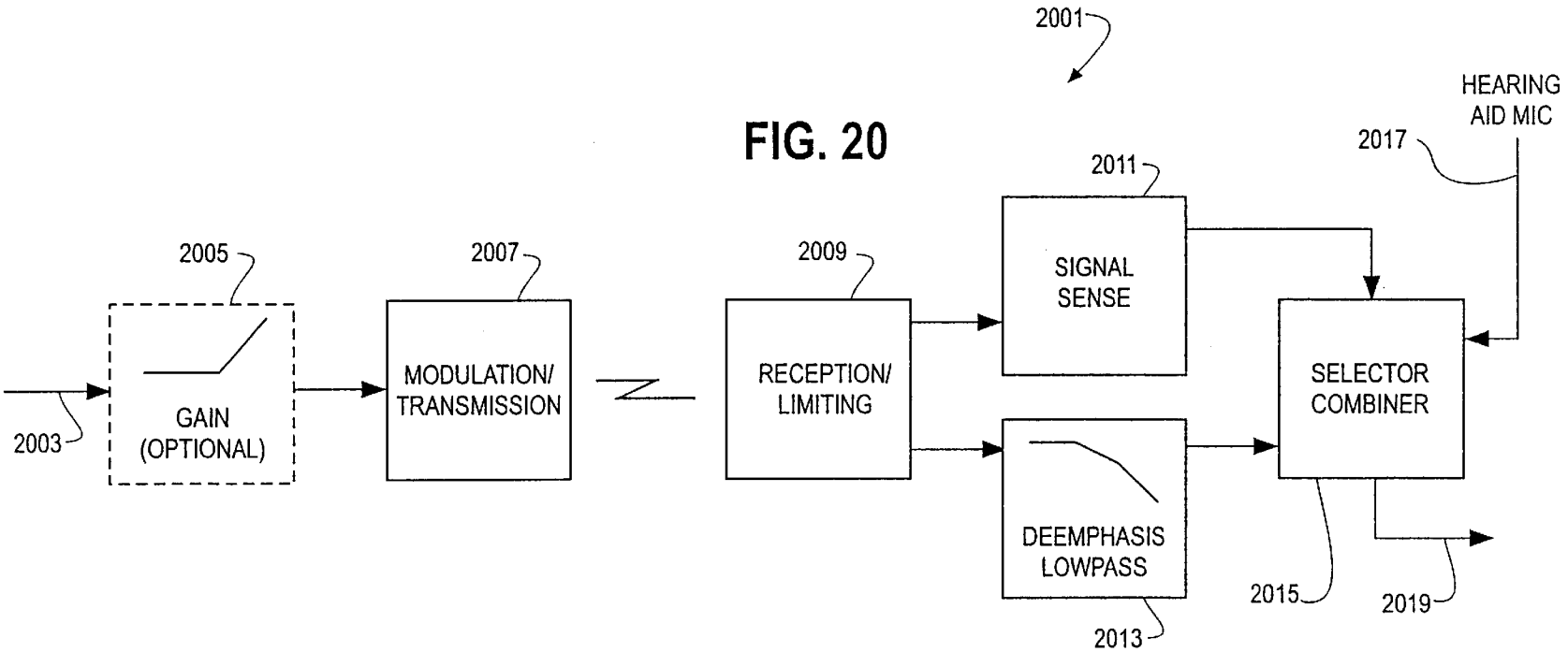
FIG. 20 is a general block diagram of an inductively coupled hearing improvement system in accordance with the present invention.

FIG. 20 is a general block diagram of an inductively coupled hearing improvement system 2001 in accordance with the present invention. An audio frequency signal 2003, which is to be inductively coupled to a hearing aid, is input to an optional gain stage block 2005. The gain stage block 2005 applies an appropriate signal level to a modulation/transmission block 2007, such that, eventually after reception and demodulation, an appropriate signal level is presented to circuitry of the hearing aid. The gain stage block 2005 may also optionally provide high frequency preemphasis (boost).

In the modulation/transmission block 2007, the modified signal from the gain block modulates a carrier of typically 100 kHz by some means for application to a transmitting inductor or other type of antenna. The transmitting inductor responsively generates a corresponding changing magnetic flux field. A reception/limiting block 2009 includes a receiving inductor some distance away from the transmitting inductor, which responds to the flux field at an attenuated level. The electrical signal produced by the receiving inductor is amplified by an amplifier sufficiently such that the amplifier output signal is limited (clipped) under normal operating conditions, and, thus, constant amplifier output signal level is maintained. The signal at this point is largely free of interfering noises, since the noises are attenuated greatly by the limiting action.

The reception/limiting block 2009 may or may not need to incorporate additional signal demodulation, depending on the modulation method employed, as will be seen in the descriptions of the following figures.

The reception/limiting block 2009 feeds both a signal sense block 2011 and a deemphasis/lowpass filter block 2013. The signal sense block 2011 determines if there is a received signal of sufficient quality to enable passing the demodulated signal on to the hearing aid circuitry. The signal sense block 2011 will typically make the decision based on whether the output signal of the previous block (i.e., block 2009) is firmly in limiting. It could also, for example, respond directly to received signal strength, respond to the level of demodulated ultrasonic noise, or could operate in some other manner.

The deemphasis/lowpass filter block 2013 employs a lowpass filter to substantially remove components of the high frequency carrier before application to the hearing aid circuitry, without substantially affecting the desired audio frequency signals. This filtering block may also provide some high frequency deemphasis (rolloff) to compensate for the initial transmitter preemphasis and restore a flat overall audio frequency range response. Such emphasis/deemphasis action reduces the higher frequency noise within the audio frequency range in the received, demodulated signal.

A selector/combiner block 2015 receives the demodulated, filtered, inductively-coupled signal and a hearing aid microphone signal 2017. At rest (meaning that no high quality inductively coupled signal is being received), the selector/combiner block 2015 passes the hearing aid microphone signal through unchanged to the remainder of the hearing aid circuitry (see, output 2019), while blocking any received signal. When the signal sense block 2011 determines that a sufficiently high quality signal is being received, it causes the selector/combiner block 2015 to pass this signal through to the hearing aid circuitry. The hearing aid microphone signal may be attenuated to reduce interfering environmental sounds for the user. This attenuation could be total, but will most often be more useful if the attenuation is limited to about 15 dB or so. This allows an acoustic room presence to be maintained when the coupled signal does not contain this information (as would an eyeglass-mounted highly directional microphone, for example). When selected, the coupled signal will normally still dominate over the hearing aid microphone signal, irrespective of the nature or source of the signal.

Figure 21:
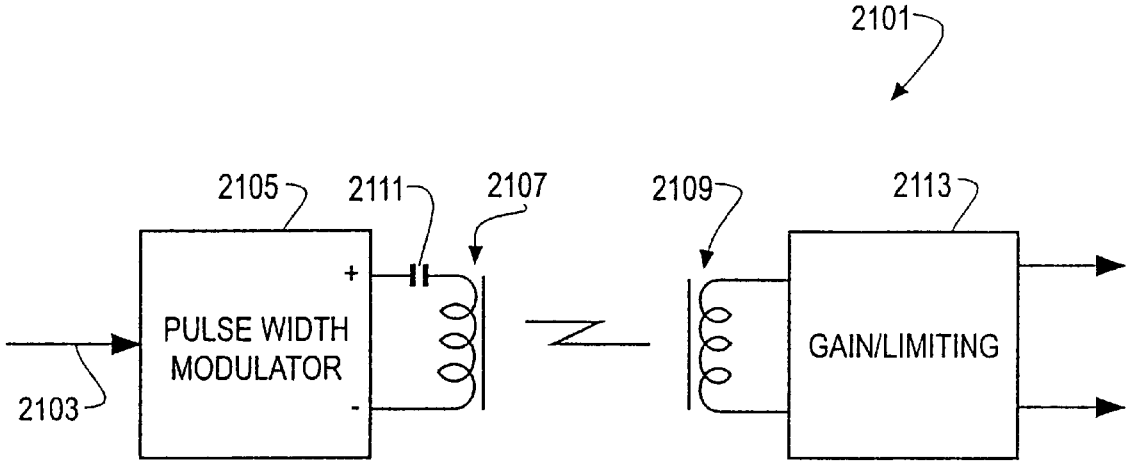
FIG. 21 illustrates a pulse width modulation system that may be used for the modulation/transmission and reception/limiting blocks of FIG. 20.

FIG. 21 illustrates a pulse width modulation system 2101 that may be used for the modulation/transmission and reception/limiting blocks of FIG. 20. In the pulse width modulation (PWM) system 2101, the gain-adjusted, pre-emphasized input signal 2103 (i.e., signal 2003 of FIG. 20) is applied to a pulse width modulator 2105. The carrier frequency is typically 100 kHz, which is well above the audio frequency range, allowing good separation of the audio and carrier information upon reception, but not so high as to make reception with very low voltage, very low power receiving circuitry difficult. The modulator circuit outputs opposite polarities of a rectangular signal whose mark/space ratio varies with the instantaneous value of the audio frequency signal input. These modulator output signals differentially drive a transmit inductor 2107.

The coupling from the transmit inductor 2107 to a physically separated receive inductor 2109 may selectively be weak. The coupling is dependent on the respective inductors' dimensions, their individual inductances, and very strongly on their separation distance. Empirically it has been found that the voltage input to voltage output coupling ratio is proportional to the core length of each inductor, roughly to the square root of the ratio of their core diameters, to the square root of the ratio of their inductances, and proportional roughly to the 2.75th power of their separation distance (at least for inductors of the approximate size and construction, and operated under the moderately separated distances and moderate frequencies studied). This can be expressed by the following empirical formula for inductors positioned end-to-end, where the dimensions are in millimeters and the result in decibels:

$$\text{coupling} = 10\log\left[\frac{L_{RX}}{L_{TX}}\right] + 10\log[\text{dia}_{RX} \times \text{dia}_{TX}] + 20\log[\text{length}_{RX} \times \text{length}_{TX}] - 55\log[\text{distance}] - 12$$

For inductors positioned side-to-side, the coupling is 6 dB less. At other orientations, coupling is variable, but can be at a null when the receive inductor 2109 core is aligned perpendicularly to the lines of flux of the transmitting inductor. For the PWM transmit and receive inductors 2107 and 2109, respectively, described more completely below, the loss given by the formula is predicted to be 25 dB at a 1 cm center-to-center spacing and 63 dB for a 5 cm spacing. The loss is greater for other relative orientations.

For a short range transmitter circuit powered by a single-cell hearing aid battery with a typical voltage of 1.3 volts, a 1 mH inductor wound on a ferrite core of diameter 1.6 mm and length 6.6 mm may be used for a compact transmitter design with reasonable transmission efficiency. Employing a low loss ferrite core inductor improves transmitter efficiency by allowing most of the stored inductor energy to be returned to the battery each cycle, instead of being dissipated in the inductor core. Peak inductor current is about 3.25 mA, but average battery current is only about 400 uA (exclusive of input circuitry), with efficient mosfet H-bridge drive transistors.

A 0.1 uF coupling capacitor 2111 forms a high-pass filter with the transmit inductor 2107, rolling off the voltage applied to the transmit inductor 2107 at 12 dB/octave below 16 kHz. The frequency is chosen to be high enough to allow large attenuation of the baseband audio frequency content while being low enough to preserve the waveform shape of the rectangular signal applied to the transmit inductor 2107. The audio frequency components of the spectrum may be attenuated to avoid the large currents that would otherwise flow into the transmit inductor 2107, which has been sized for proper transmission of the much higher frequency carrier. The resulting rectangular voltage waveform which is applied to the transmit inductor 2107 changes its peak positive and negative levels under modulation along with its mark/space ratio such as to maintain a near zero average voltage level.

The receive inductor 2109 may have a value of about 10 mH at frequencies in the 100 kHz range and be wound on a steel bobbin of overall length 5.5 mm and bobbin diameter 0.6 mm. Receive inductor 2109 configured as such would have an equivalent parallel capacitance of about 9 pF. Together with other stray circuit capacitance, this will result in receive inductor 2109 input circuit with a resonance of about 500 kHz. The received PWM voltage waveform will have harmonics above this frequency rolled off, or equivalently, have its leading edges rounded. Sufficient parallel circuit loading may be added (typically about 50 kOhms) so that, in conjunction with the inductor core losses, the input circuit Q is about 0.7. This choice allows the sharpest leading edge transitions to be received to maintain sensitivity to narrow pulses, while minimizing overshoot and ringing. The overall receive inductor 2109 input circuit frequency response enables adequate waveform fidelity for pulse detection over a full range of transmitted mark/space ratios from 50/50 to 90/10.

The receive inductor 2109 voltage may be amplified approximately 70 dB, for example, by a multistage amplifier 2113 having a sufficiently wide bandwidth so as not to significantly degrade its input signal. (Some bandwidth tradeoff is possible between the amplifier and the inductor circuit: i.e., widening the inductor circuit bandwidth or increasing the Q slightly to allow some effective reductions in each of these by the amplifier.) The amplifier 2113 is designed such as to not exhibit behavioral problems over a very wide range of input signal levels, corresponding to differing transmit-receive inductor spacings and orientations. The amplifier 2113 is also designed to cleanly and stablely limit the output signal to consistent high and low levels. The high and low levels may be separated by two Shottky or PN junction diode drops. The amplifier 2113 will be in a limiting condition whenever the received signal is usable. By restoring consistent high and low levels to the PWM signal, the baseband audio frequency content is also restored. This can be considered a form of demodulation, in that only filtering to remove the (now unwanted) carrier signal is needed to restore the original audio frequency range signal.

In the PWM signal, the audio modulation information is carried by the timing of the transitions. It is possible to transmit greater peak flux rates of change for the same transmitter power consumption by transmitting essentially only those transitions. These transitions can be considered the derivitive of the PWM signal. These could be obtained by reducing the value of the coupling capacitor in FIG. 21, but obtaining strong pulses would require high peak battery and switch currents, with very low drain during most of the cycle.

Figure 22:
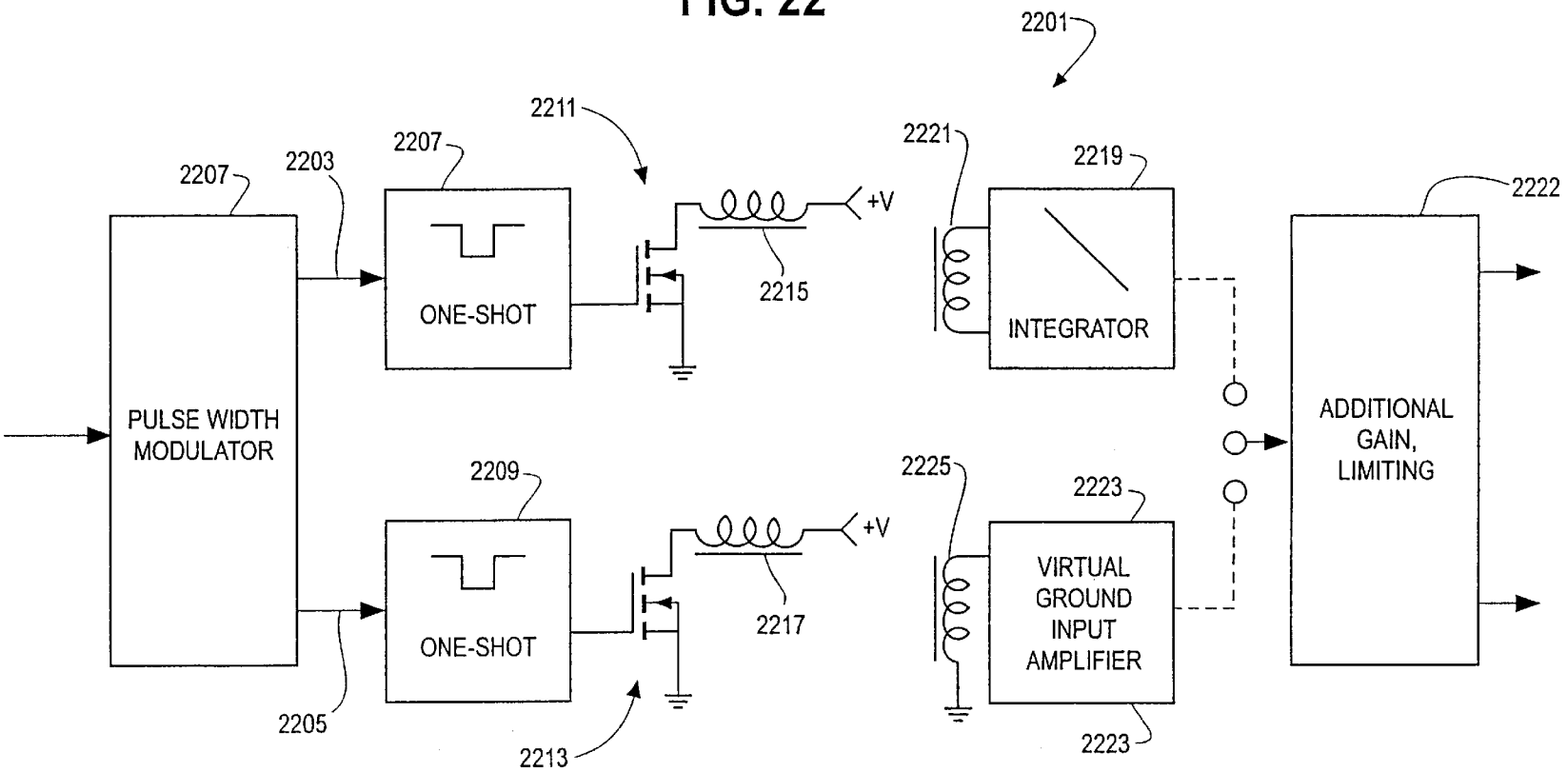
FIG. 22 shows a system to obtain large transition spikes with lower, more continuous battery and switch currents in accordance with one embodiment of the present invention.

FIG. 22 shows a system 2201 to obtain large transition spikes with lower, more continuous battery and switch currents. Opposite polarity outputs 2203 and 2205 of a low power 100 kHz pulse width modulator 2207 each trigger a respective 1.5 usec, for example, one-shot monostable multivibrator (i.e., one-shots 2207 and 2209). These, in turn, each turn off a corresponding switch (i.e., switches 2211 and 2213) for that time period on opposite PWM signal transitions. Each switch normally connects an associated inductor (i.e., inductors 2215 and 2217) to ground. The opposite end of each of the inductors 2215 and 2217 is connected to the positive voltage supply. During most of the cycle, each of the inductors 2215 and 2217 is being charged with current. When an associated switch opens in response to its associated one-shot, the inductor voltage rings up to a voltage many times the supply voltage before ringing back down to discharge its remaining reversed current into a reverse catch diode associated with the switch. This ring will last for just over one-half cycle of the inductor circuit resonant frequency. The inductors 2215 and 2217 are normally arranged in opposition, so that each alternating spike generates a changing flux field of opposite, alternating polarity. Depending on the demodulation method chosen, the spikes could alternatively be made to go in the same direction.

For a 1.3 volt short range transmitter, low-loss 3 mH inductors wound on the cores previously described for the PWM transmitter may be used. These will have in-circuit resonances of 500 kHz, resulting in 1 usec pulses of approximately 13 volt peak amplitude, depending on battery voltage. Each of the inductors 2215 and 2217 can achieve peak currents of about 1.7 mA, yet the average battery drain of both inductor circuits, with efficient switches, is about 400 uA (exclusive of input and PWM circuitry).

The switches 2211 and 2213 are shown in FIG. 22 as N-channel enhancement mode mosfet switches. These may be used due to their low switching losses, inherent reverse catch diode, and ability to conduct both directions of current with low loss when switched on. The timing of the one-shots 2207 and 2209 may be reliably just greater than the ring-back time of their respective inductors, so that the transistor can quickly revert to a low loss condition following the return of reverse current flow, with minimal time spent relying on the catch diode. The mosfet may have a <1 volt turn-on gate voltage and the ability to withstand >13 volt drain-source spikes.

In order to receive most of the available signal strength of the transmitted signal and not excessively lengthen the signal's rise and fall times, and assuming conventional sensing and amplification of receive inductor voltage, a receive inductor circuit for FIG. 22 may have a resonant frequency at least as great as, and preferably greater than the transmit inductors 2215 and 2217. A 3 mH inductor may be used, wound on a the same steel bobbin as just described for the PWM receiver can have an in-circuit resonance of 800 kHz. The Q may be controlled to about 0.7 with parallel resistive loading in conjunction with the core loss, to prevent excessive ringing while maintaining adequate pulse rise and fall times.

FIG. 22 suggests two potential means of obtaining a PWM-equivalent signal. In a integrator block 2219, a receive inductor 2221 voltage is amplified and integrated. If the received signal, with its opposite polarity spikes, is simply integrated as such, then an equivalent PWM signal is recovered. It can be also be amplified, limited, and filtered by circuitry of block 2222 in the same manner as discussed in connection with FIG. 21.

Alternatively, in a block 2223, the receive inductor 2225 is operated into a virtual ground amplifier input. The amplifier senses directly the received flux level, which is already proportional to the integral of the summed transmitter inductor voltages. Once the PWM-equivalent signal is obtained, it can likewise also be amplified, limited, and filtered by circuitry of block 2222 in the same manner as discussed in connection with FIG. 21.

In this virtual ground amplifier configuration, the circuit sensitivity to equivalent parallel inductor capacitance and resistance is low. A roughly 3 mH inductor value may be used, as discussed more completely below.

Another possible method of demodulating the audio information from the received pulses is to sense the peak recovered positive and negative signal amplitudes, ignore all signals of lesser amplitude, set and reset a flip-flop, and then low pass filter the flip-flop output.

Figure 23:
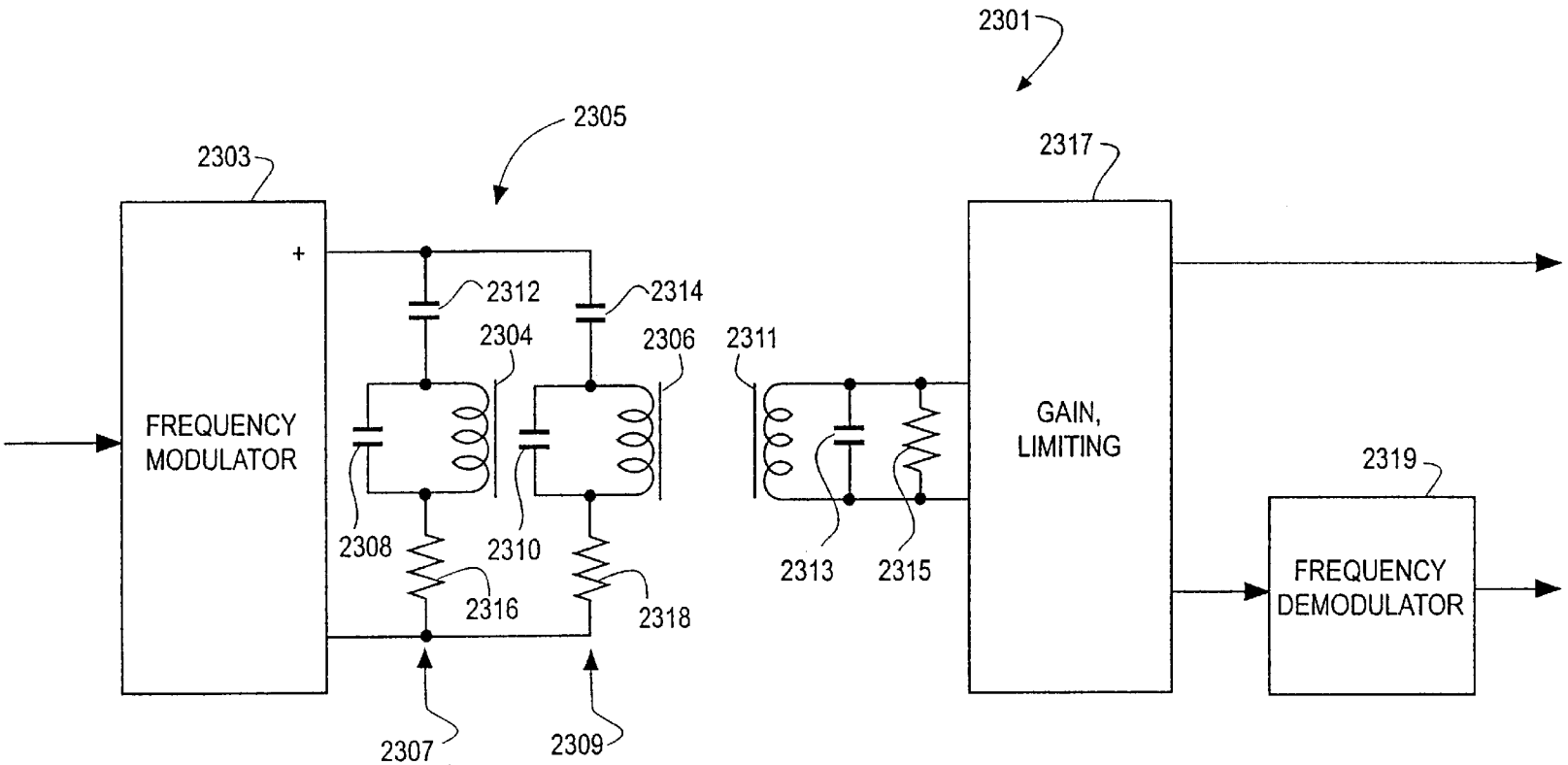
FIG. 23 illustrates a frequency modulation system in accordance with the present invention.

To enhance the system's rejection of interferences and possibly allow for multi-channel operation, frequency modulation ("FM") may be used instead of the pulse width based systems discussed with respect to FIGS. 21 and 22. FIG. 23 illustrates a FM system 2301 in accordance with the present invention. Roughly +/−10 kHz peak deviation of a 100 kHz carrier may be used. Since, unlike the previously discussed modulation methods, harmonics of the carrier frequency are not needed, the transmit inductor drive circuit may be operated into an inductor circuit which is mildly resonant in the region of the carrier frequency, thus enhancing the proportion of energy maintained in the waveform fundamental.

In FIG. 23, a frequency modulator 2303 provides a frequency modulated square wave drive to a transmit inductor network 2305. In order to provide a reasonably flat amplitude response and linear phase response over a 20 kHz band around 100 kHz, dual resonant inductor circuits 2307 and 2309, stagger-tuned on either side of 100 kHz may be employed. When combined with a single resonant receive inductor circuit, the net transmit-receive frequency response achieves a flat pass-band. The following curves represent the transmitted flux frequency response (lower curve), the received flux frequency response (middle curve), and the net inductor-to-inductor frequency response (upper curve) for the system 2301 of FIG. 23.

A low voltage, low power short range transmitter network, such as network 2305, may comprise 10 mH ferrite core inductors 2304 and 2306 of the dimensions previously discussed, for example, equivalent parallel capacitors 2308 and 2310 (having capacitance of 30 pF, for example), added series capacitance 2312 and 2314 (having capacitance of 297 and 174 pF, respectively, for example), and total series resistors 2316 and 2318 (having 1.3 and 1.4 kOhm resistances, respectively, for example) in the configuration shown in FIG. 23. This configuration gives resonances for the circuits 2307 and 2309 at 88 kHz and 111 kHz, both with Q's of about 5. Assuming an efficient mosfet H-bridge drive circuit is used, the peak joint inductor current will be about 850 uA with an average battery current (exclusive of input circuitry) of about 600 uA.

A receive inductor 2311 may be of a much higher value than with the other modulation approaches, which allows a significant increase in sensitivity. A 100 mH inductor wound on the steel bobbin previously described can have a 99 kHz resonance using a total circuit+inductor capacitor 2313 having a capacitance of 26 pF, for example. In conjunction with a resistor 2315 having 340 kOhm of total equivalent and actual parallel loading resistance, for example, a Q of just over 5 results. The combination of high inductor value and under-damped response allows a very high effective sensitivity. A limiting amplifier 2317 that follows can have significantly less gain than the previous systems. The limited amplifier output signal contains no base-band audio content and must be demodulated by a block 2319 using any of the known FM demodulation methods.

The transmitted FM signal of a system such as shown in FIG. 23 has significantly less harmonic content than do the other described transmitters, but some high frequency content may remain due to the original square wave drive. This high frequency content may be further reduced by additional filtering between the drive circuitry and the transmitting inductor, utilizing very small or well-shielded inductors with minimal radiating potential.

FIGS. 24–27 show in detail circuitry that may be employed to implement the pulse width modulation embodiment of FIGS. 20 and 21. The input signal may be derived from an eyeglass-mounted highly directional array microphone. The transmitter circuitry may also be mounted on the eyeglass. Both the array microphone and the transmitter may be powered by a single 1.5 volt nominal hearing aid battery. The receiver circuitry provides automatic switchover from an ear canal mountable hearing aid type microphone.

Figure 24:
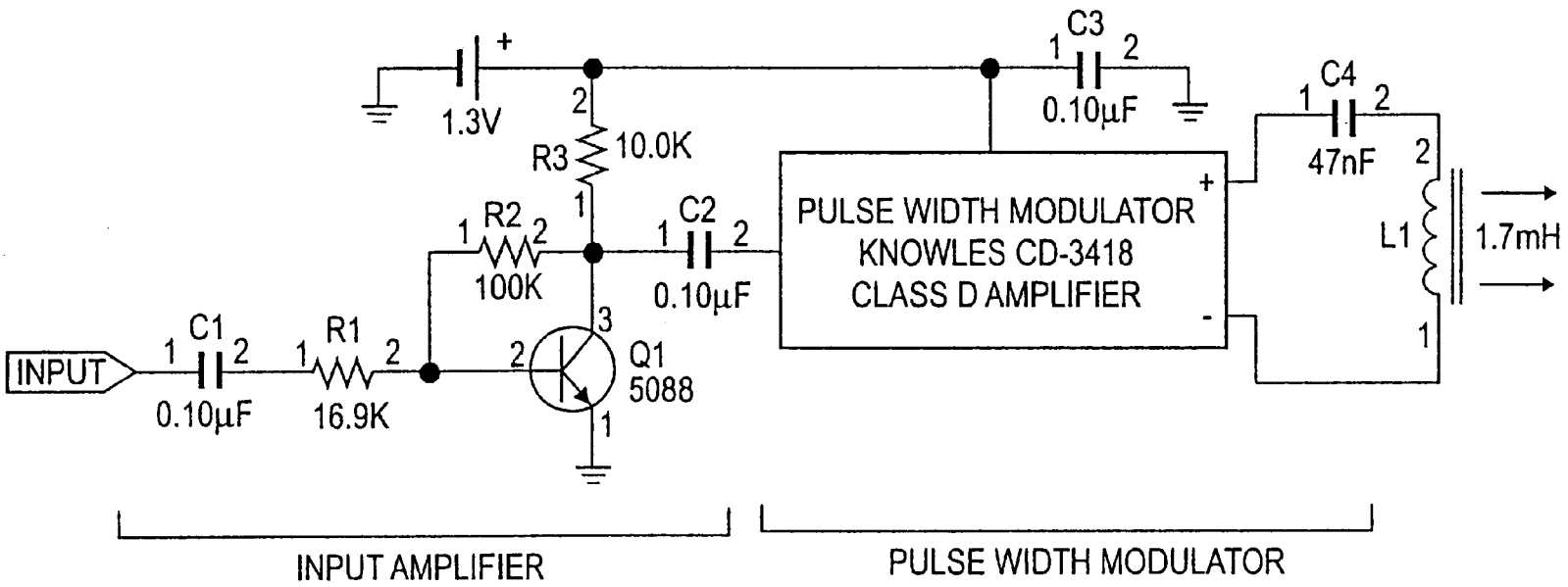
FIG. 24 shows a single stage amplifier that raises an audio frequency input signal strength to an optimum range for a pulse width modulated hybrid in accordance with the present invention.

FIG. 24 corresponds to blocks 2005 and 2007 of FIG. 20, and shows a single stage amplifier that raises the audio frequency input signal strength to the optimum range for the PWM hybrid. This hybrid, a Knowles CD-3418 (ref. Knowles Electronics, Inc. CD Series Data Sheet), is intended for use as a class D audio amplifier for use in driving hearing aid receivers. It does this by providing both output polarities of a pulse width modulated output through a mosfet H-bridge. Blocking capacitor C4 prevents excessive inductor currents that would otherwise result from audio frequencies and DC offset. For convenience, transmit inductor L1 is constructed by the parallel combination of eight Tibbetts Industries, Inc. model Y09–31-BFI telecoils. Total current drain (exclusive of the array microphone) is 750 uA.

Figure 25:
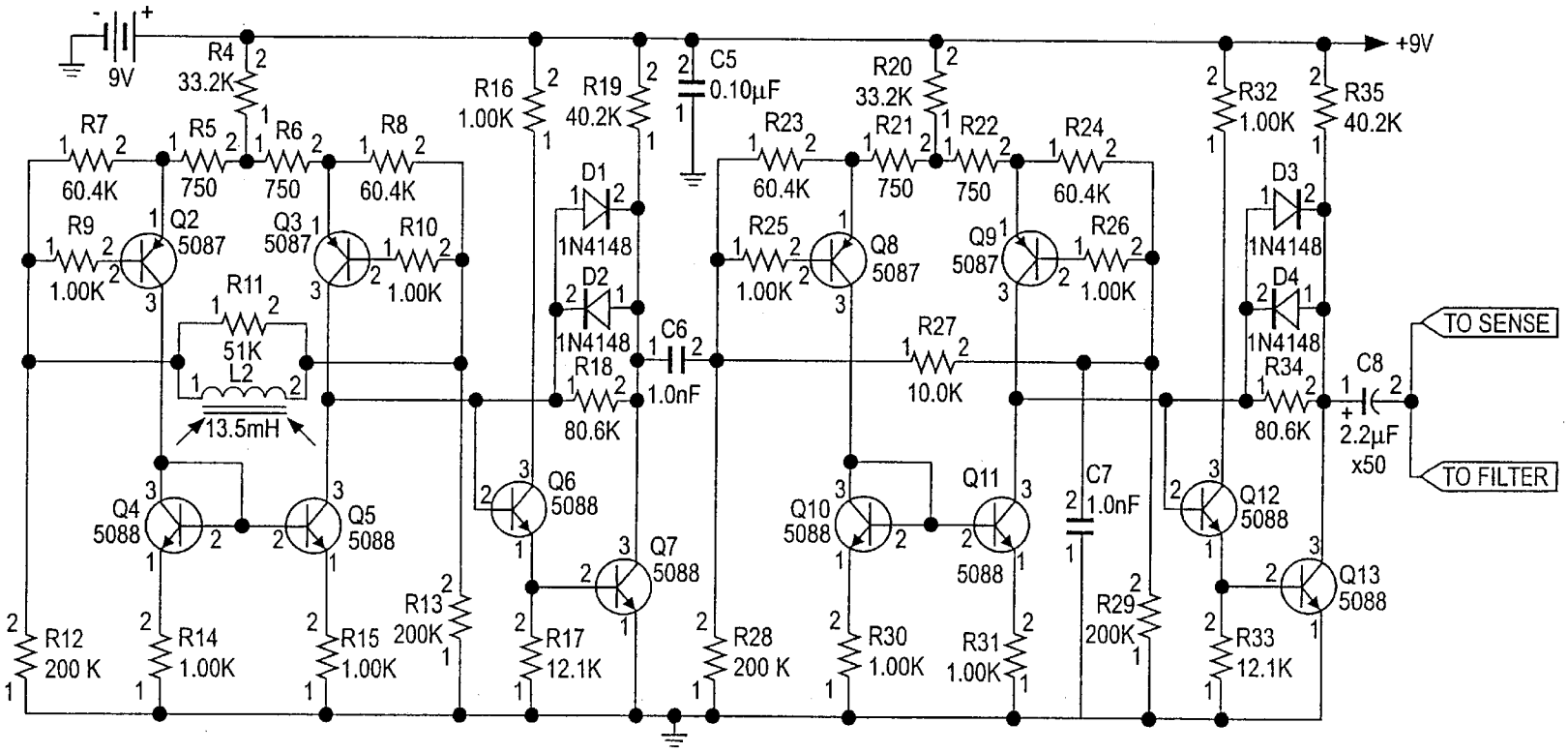
FIG. 25 provides additional exemplary detail regarding a portion of the block diagram in FIG. 20.

FIG. 25 corresponds to block 2009 of FIG. 20. Two cascaded amplifier stages provide a total of 68 dB of gain for the 100 kHz PWM signal received from inductor L2, a Tibbetts Industries, Inc. model Y09–31-BFI telecoil. An input circuit Q of about 0.7 is obtained through the combination of the coil characteristics and the circuit loading, particularly the paralleled 51 kOhm resistor, R11. The output signal amplitude remains at a consistent peak-to-peak level of two silicon diode drops for transmitter-receiver distances from less than 1 cm to roughly 6 to 8 cm (end-to-end coil orientation).

Figure 26:
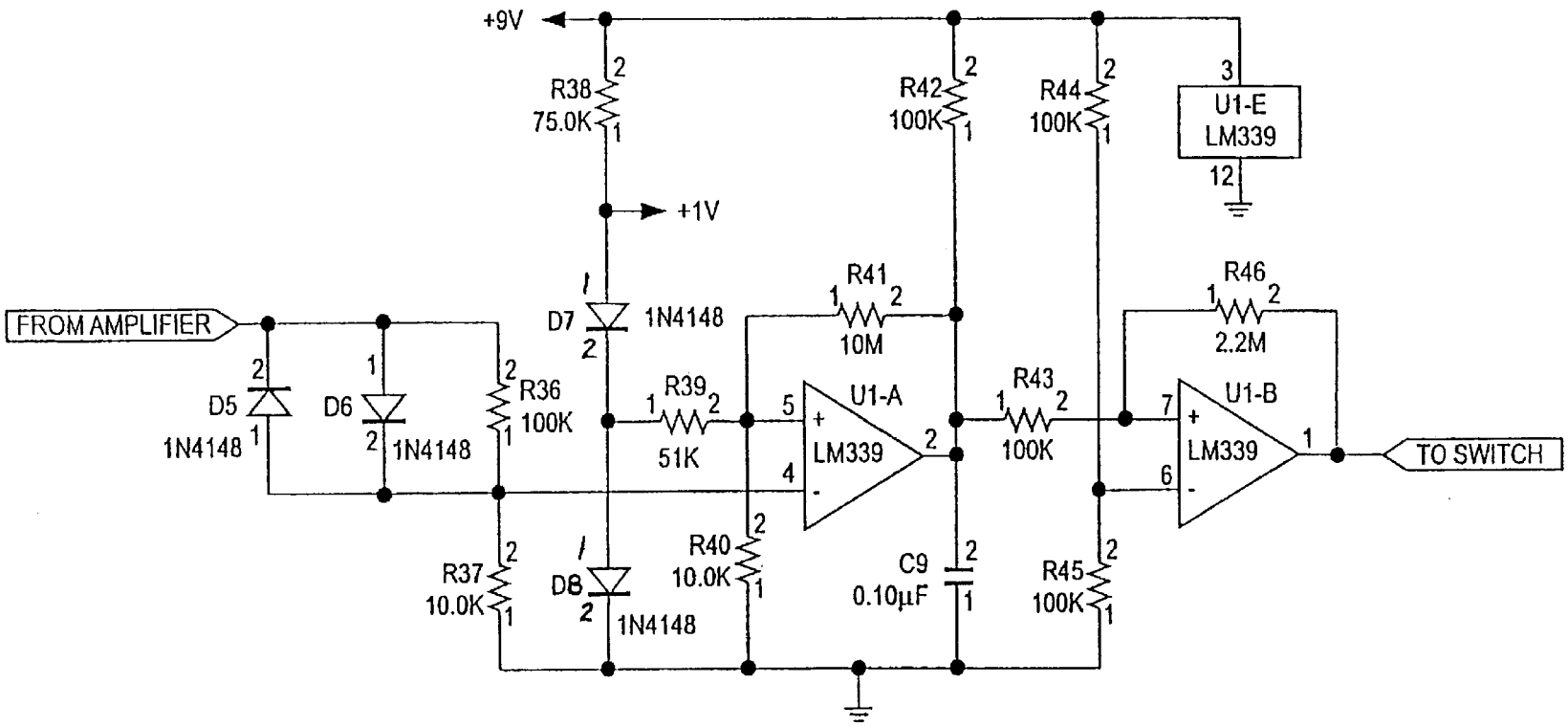
FIG. 26 provides additional exemplary detail regarding another portion of the block diagram in FIG. 20.

FIG. 26 corresponds to block 2011 of FIG. 20. The signal sense circuitry receives a ground-referenced signal from the output of the amplifier. If the amplifier of FIG. 25 is driven sufficiently strongly into limiting at least every 7 msec, indicating adequate received signal strength, the output of this circuit block pulls to ground. This will result in the enabling of the inductively received signal. This circuit also provides a 1 volt supply for the hearing aid microphone.

Figure 27:
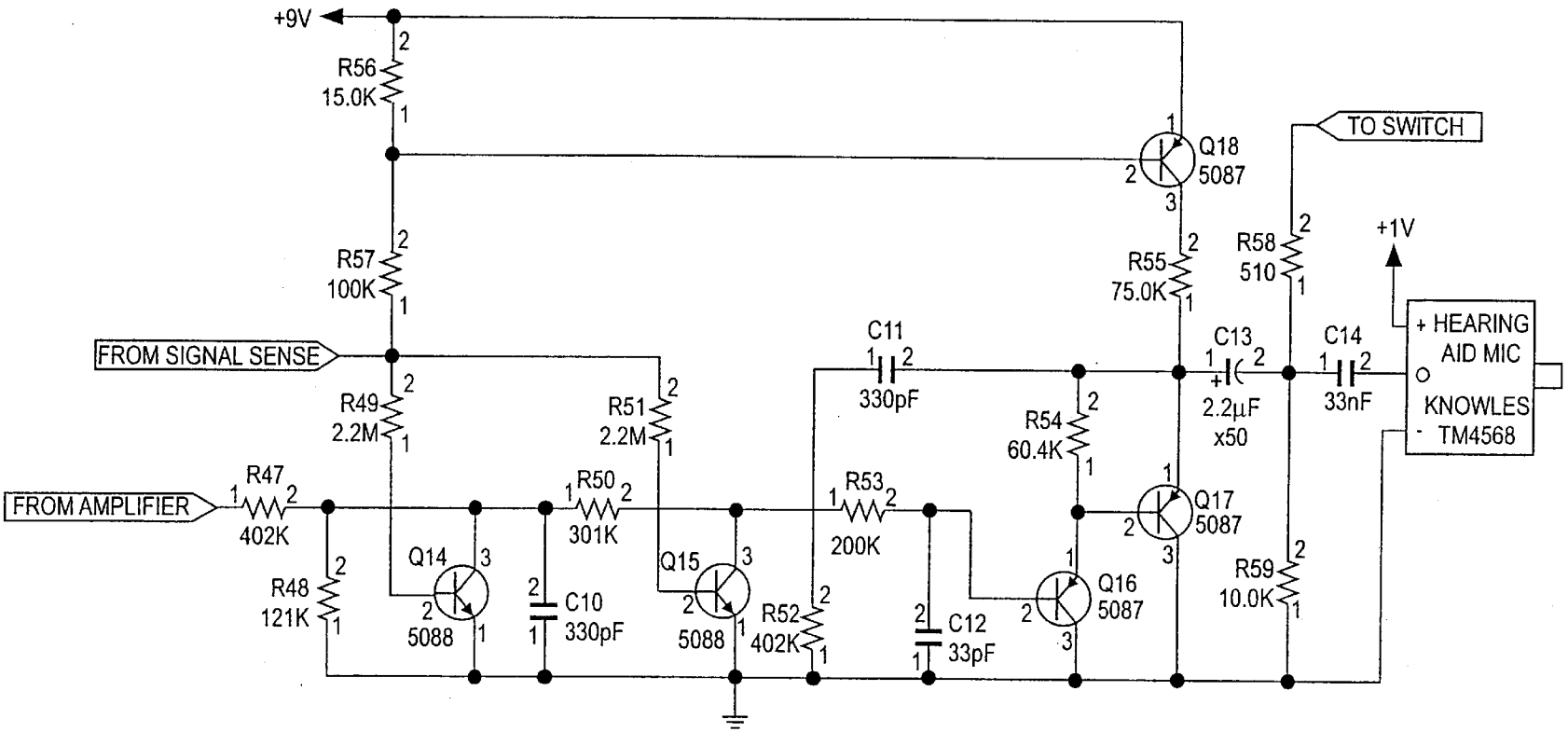
FIG. 27 provides additional exemplary detail regarding other portions of the block diagram in FIG. 20.

FIG. 27 corresponds to the blocks 2013 and 2015 of FIG. 20. When the output of the signal sense block (FIG. 26) is not pulled low, indicating that the inductively coupled signal is not of useful strength, output transistors Q16 and Q17 are not powered up by transistor Q18 and the drive signal to output transistors Q16 and Q17 is shorted to ground by transistors Q14 and Q15. The signal from the hearing aid microphone, in this case a Knowles Electronics, Inc. TM4568, is allowed to pass with virtually no loading or attenuation. When the signal sense output is pulled low, the output transistors are powered up and the signal from the amplifier is allowed to pass through the 3rd order, 6 kHz low pass filter on to the output. The low output impedance of the powered output transistor stage attenuates the hearing aid microphone signal by about 20 dB, so that the inductively received signal may dominate. It may be generally desirable that the hearing aid microphone not be attenuated too deeply, though, so that a sense of the room will not be lost in applications where the inductively coupled signal does not provide such a sense. The degree of attenuation of the hearing aid microphone signal may be reduced from that shown by, for example, reduction of the bias current level in transistor Q17 or insertion of a build-out resistor in series with capacitor C13.

The system described with reference to FIGS. 24–27 above delivers an A-weighted signal-to-noise ratio of about 65 dB, referred to the maximum signal level, at a distance of 2 cm. The system transitions between the hearing aid microphone and the inductively coupled microphone at a distance of 6 to 8 cm, at which point the signal-to-noise ratio is reduced by 15–20 dB from the 2 cm value. The distortion at 1 kHz just below clipping is 1%.

Figure 28:
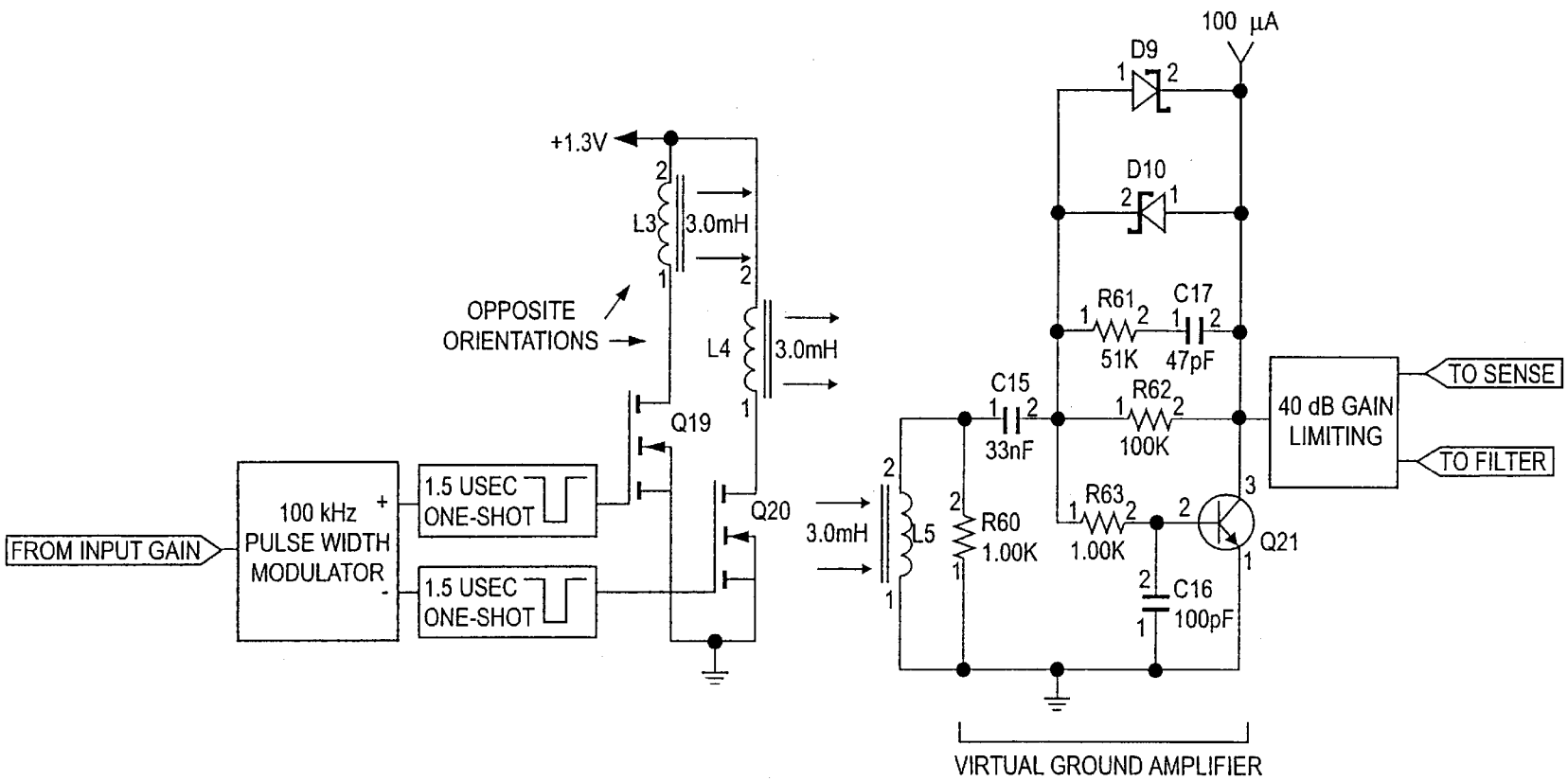
FIG. 28 shows exemplary detail of the circuitry suggested by the block diagram of FIG. 22.

FIG. 28 shows somewhat more exemplary detail of the circuitry suggested by the block diagram of FIG. 22. The 100 kHz pulse width modulator has the same functionality as the similar block in FIG. 24, but with the need only for low power output stages. The one-shot timing may be achieved by any of several known methods.

The virtual ground receive inductor input amplifier shown has an input impedance of about 300 Ohms. This is lower than the inductor impedance at frequencies above 16 kHz. By amplifying the virtual short circuit inductor current, the circuit responds essentially to the induced inductor flux, which is essentially the integral of its open circuit voltage. By amplifying this signal, an equivalent PWM signal appears at the stage output. The lower frequency rolloff and resultant waveform droop in the recovered signal caused by the finite stage input impedance and coupling capacitor C15 can be partially compensated by the shelving feedback network R61, R62, and C17. An advantage of the low stage input impedance is that it enables additional capacitance to be added at the input for improved filtering of radio frequency interference. This is accomplished here by R63 and C16. R60 helps stabilize the stage under overdrive conditions.

Many modifications and variations of the present invention are possible in light of the above teachings. Thus, it is to be understood that, within the scope of the appended claims, the invention may be practiced otherwise than as described hereinabove.

What is claimed and desired to be secured by Letters Patent is:

1.A hearing aid system comprising:

hearing aid circuitry;

a first audio source for generating a first audio signal;

a second audio source for generating a second audio signal, the second audio source having a wireless transmitter for transmitting the second audio signal wirelessly;

a receiver for receiving the second audio signal from the wireless transmitter of the second audio source; and circuitry for analyzing the second audio signal received, and for selecting at least one of the first and second audio signals for coupling to the hearing aid circuitry based on the analysis of the second audio signal received, the circuitry coupling a combination of the second audio signal and the first audio signal attenuated by less than a predetermined amount when the analysis indicates that the second audio signal meets a selected criterion, and coupling only the first audio signal to the hearing aid circuitry when the analysis indicates that the second audio signal does not meet the selected criterion.

2. The hearing aid system of claim 1 wherein the first audio source comprises an omnidirectional hearing aid microphone.

3. The hearing aid system of claim 1 wherein the first audio source comprises a directional hearing aid microphone.

4. The hearing aid system of claim 1 wherein the secondary audio source comprises one of a directional microphone, an array microphone, an audio transmitter, or a telephone.

5. The hearing aid system of claim 1 wherein the circuitry selects the second audio signal if the second audio signal is above a predetermined threshold.

6. The hearing aid system of claim 1 wherein the hearing aid circuitry comprises a hearing aid amplifier and a speaker.

7. The hearing aid system of claim 1 wherein the hearing aid circuitry comprises a speaker.

8. A hearing aid comprising;

hearing aid circuitry;

a microphone for generating a first audio signal;

a receiver for wirelessly receiving a second audio signal generated externally to the hearing aid; and circuitry for analyzing the second audio signal received, and for selecting at least one of the first and second audio signals for coupling to the hearing aid circuitry based on the analysis of the second audio signal received, the circuitry coupling a combination of the second audio signal and the first audio signal attenuated by less than a predetermined amount when the analysis indicates that the second audio signal meets a selected criterion, and coupling only the first audio signal to the hearing aid circuitry when the analysis indicates that the second audio signal does not meet the selected criterion.

9. The hearing aid of claim 8 wherein the microphone is one of a directional or an omnidirectional microphone.

10. The hearing aid system of claim 8 wherein the circuitry selects the second audio signal if the second audio signal is above a predetermined threshold.

11. The hearing aid system of claim 8, wherein the hearing aid circuitry comprises a hearing aid amplifier and a speaker.

12. The hearing aid system of claim 8 wherein the hearing aid circuitry comprises a speaker.

13. A hearing aid system comprising:

hearing aid circuitry;

a first audio source for generating a first audio signal;

a receiver for receiving a second audio signal wirelessly from a second audio source;

a detector for detecting receipt of the second audio signal and for generating a control signal based thereon, the control signal having at least a first state and a second state; and an electronic switch for selecting at least one of the first audio signal and the second audio signal based on the control signal generated by the detector, and for coupling to the hearing aid circuitry a combination of the second audio signal and the first audio signal attenuated by less than a predetermined amount when the control signal is in the first state, and coupling only the first audio signal to the hearing aid circuitry when the control signal is in the second state.

14. The hearing aid system of claim 13 wherein the first audio source comprises an omnidirectional hearing aid microphone.

15. The hearing aid system of claim 13 wherein the first audio source comprises a directional hearing aid microphone.

16. The hearing aid system of claim 13 wherein the secondary audio source comprises one of a directional microphone, an array microphone, an audio transmitter, or a telephone.

17. The hearing aid system of claim 13 wherein the hearing aid circuitry comprises a hearing aid amplifier and a speaker.

18. The hearing aid system of claim 13 wherein the hearing aid circuitry comprises a speaker.

19. A hearing aid comprising;

hearing aid circuitry;

a microphone for generating a first audio signal;

a receiver for wirelessly receiving a second audio signal generated externally to the hearing aid;

a detector for detecting receipt of the second audio signal and for generating a control signal based thereon, the control signal having at least a first state and a second state; and an electronic switch for selecting at least one of the first audio signal and the second audio signal based on the control signal generated by the detector, and for coupling to the hearing aid circuitry a combination of the second audio signal and the first audio signal attenuated by less than a predetermined amount when the control signal is in the first state, and coupling only the first audio signal to the hearing aid circuitry when the control signal is in the second state.

20. The hearing aid system of claim 19 wherein the microphone is one of a directional or an omnidirectional microphone.

21. The hearing aid system of claim 19 wherein the hearing aid circuitry comprises a hearing aid amplifier and a speaker.

22. The hearing aid system of claim 19 wherein the hearing aid circuitry comprises a speaker.

23. A method of operating a hearing aid system comprising:

generating a first audio signal;

generating a second audio signal;

wirelessly transmitting the second audio signal;

receiving the second audio signal;

analyzing the second audio signal received;

selecting at least one of the first and second audio signals based on the analysis of the second audio signal received;

attenuating the first audio signal by less than a predetermined amount if the second audio signal is selected;

refraining from attenuating the first audio signal if only the first audio signal is selected;

combining the selected signals to produce a combined signal; and coupling the combined signal to an input.

24. A method of operating a hearing aid system comprising:

generating a first audio signal;

receiving a wirelessly transmitted second audio signal;

analyzing the second audio signal received;

selecting at least one of the first and second audio signals based on the analysis of the second audio signal received;

attenuating the first audio signal by less than a predetermined amount if the second audio signal is selected;

refraining from attenuating the first audio signal if only the first audio signal is combining the selected signals to produce a combined signal; and coupling the combined signal to an input.

25. A method of operating a hearing aid system comprising:

generating a first audio signal;

receiving a wirelessly transmitted second audio signal;

determining whether the second audio signal received meets a selected criterion;

coupling the second audio signal combined with the first audio signal attenuated by less than a predetermined amount to an input if the second audio signal meets the selected criterion; and coupling only the first audio signal to the input if the second audio signal does not meet the selected criterion.

26. A method of operating a hearing aid system comprising:

generating a first audio signal;

generating a second audio signal;

wirelessly transmitting the second audio signal;

receiving the second audio signal;

determining whether the second audio signal received meets a selected criterion;

coupling the second audio signal combined with the first audio signal attenuated by less than a predetermined amount to an input if the second audio signal meets the selected criterion; and coupling only the first audio signal to the input if the second audio signal does not meet the selected criterion.

27. The hearing aid of claim 1 wherein the predetermined amount is approximately 20 dB.

28. The hearing aid of claim 1 wherein the second audio signal is transmitted using a pulse width modulated magnetic field.

29. The hearing aid of claim 1 wherein the second audio signal is transmitted using a frequency modulated magnetic field.

30. The hearing aid of claim 29 wherein the wireless transmitter comprises at least two transmit inductors, each of the at least two transmit inductors being arranged to have a different peak frequency response.

31. The hearing aid of claim 8 wherein the predetermined amount is approximately 20 dB.

32. The hearing aid of claim 13 wherein the predetermined amount is approximately 20 dB.

33. The hearing aid system of claim 19 wherein the predetermined amount is approximately 20 dB.

34. The method of claim 23 wherein the predetermined amount is approximately 20 dB.

35. The method of claim 23 wherein the transmitting is accomplished using a pulse width modulated magnetic field.

36. The hearing aid of claim 23 wherein the transmitting is accomplished using a frequency modulated magnetic field.

37. The hearing aid of claim 36 wherein the transmitting uses at least two transmit inductors, each of the at least two transmit inductors being arranged to have a different peak frequency response.

38. The method of claim 24 wherein the predetermined amount is approximately 20 dB.

39. The method of claim 25 the predetermined amount is approximately 20 dB.

40. The method of claim 26 wherein the predetermined amount is approximately 20 dB.

* * * * *